US007378205B2

(12) United States Patent
Sekiya et al.

(10) Patent No.: US 7,378,205 B2
(45) Date of Patent: May 27, 2008

(54) ELECTROPHOTOGRAPHIC PHOTOSENSITIVE MEMBER, PROCESS CARTRIDGE, AND ELECTROPHOTOGRAPHIC APPARATUS

(75) Inventors: Michiyo Sekiya, Shizuoka (JP); Hiroki Uematsu, Chiba (JP); Shuji Ishii, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 261 days.

(21) Appl. No.: 10/896,856

(22) Filed: Jul. 23, 2004

(65) Prior Publication Data

US 2005/0019684 A1 Jan. 27, 2005

(30) Foreign Application Priority Data

Jul. 25, 2003 (JP) ..... 2003-280190

(51) Int. Cl.
*G03G 5/14* (2006.01)

(52) U.S. Cl. ..... 430/66; 430/130; 399/262

(58) Field of Classification Search ..... 430/66, 430/130; 399/262
See application file for complete search history.

(56) References Cited

U.S. PATENT DOCUMENTS

| | | | | |
|---|---|---|---|---|
| 4,985,330 | A | 1/1991 | Tsuchiya et al. | 430/130 |
| 5,391,449 | A * | 2/1995 | Maruyama et al. | 430/66 |
| 5,411,827 | A | 5/1995 | Tamura et al. | 430/58 |
| 5,427,880 | A | 6/1995 | Tamura et al. | 430/59 |
| 5,455,135 | A | 10/1995 | Maruyama et al. | 430/58 |
| 5,496,671 | A | 3/1996 | Tamura et al. | 430/58 |
| 6,110,628 | A | 8/2000 | Sekiya et al. | 430/66 |
| 6,180,303 | B1 | 1/2001 | Uematsu | 430/59.6 |
| 6,372,397 | B1 * | 4/2002 | Maruyama et al. | 430/59.6 |
| 6,416,915 | B1 | 7/2002 | Kikuchi et al. | 430/56 |
| 6,436,597 | B2 | 8/2002 | Maruyama et al. | 430/59.6 |
| 6,773,856 | B2 | 8/2004 | Tanaka et al. | 430/59.2 |
| 2002/0018953 | A1 * | 2/2002 | Maruyama et al. | 430/130 |
| 2002/0045116 | A1 * | 4/2002 | Morikawa et al. | 430/66 |
| 2003/0143475 | A1 | 7/2003 | Tanaka et al. | 430/59.3 |
| 2004/0043312 | A1 | 3/2004 | Kikuchi et al. | 430/56 |
| 2004/0063014 | A1 | 4/2004 | Yoshimura et al. | 430/59.6 |
| 2005/0117944 | A1 | 6/2005 | Kawada et al. | 399/349 |
| 2005/0196196 | A1 | 9/2005 | Ohta et al. | 399/159 |
| 2005/0244737 | A1 | 11/2005 | Baba et al. | 430/120 |
| 2005/0254856 | A1 | 11/2005 | Miura et al. | 399/159 |

FOREIGN PATENT DOCUMENTS

| | | |
|---|---|---|
| EP | 1001316 | 11/1999 |
| EP | 0964309 | 12/1999 |
| JP | 02-127652 | 5/1990 |
| JP | 05-216249 | 8/1993 |
| JP | 07-72640 | 3/1995 |
| JP | 2000-66425 | 2/2000 |
| JP | 2000-66424 | 3/2000 |
| JP | 2000-206715 | 7/2000 |
| JP | 2001-125298 | 5/2001 |
| JP | 2003-207913 | 7/2003 |

* cited by examiner

*Primary Examiner*—John L Goodrow
(74) *Attorney, Agent, or Firm*—Fitzpatrick, Cella, Harper & Scinto

(57) ABSTRACT

The present invention provides an electrophotographic photosensitive member having a support and a photosensitive layer on the support, the electrophotographic photosensitive member having a surface with a universal hardness (HU) in the range of between 150 and 220 N/mm$^2$ and an elastic deformation ratio in the range of between 50 and 65%. The present invention also provides a process cartridge and an electrophotographic apparatus each having the electrophotographic photosensitive member.

8 Claims, 4 Drawing Sheets

ELECTROPHOTOGRAPHIC PHOTOSENSITIVE MEMBER, PROCESS CARTRIDGE, AND ELECTROPHOTOGRAPHIC APPARATUS

FIELD OF THE INVENTION

The present invention relates to an electrophotographic photosensitive member, and to a process cartridge and an electrophotographic apparatus each having the electrophotographic photosensitive member.

DESCRIPTION OF THE RELATED ART

An electrophotographic photosensitive member needs to have sensitivity and electrical and optical properties corresponding to an electrophotographic process which is applied to the electrophotographic photosensitive member. The electrophotographic photosensitive member also needs to have durability against electrical and/or mechanical external forces such as charging, exposure (image exposure), development with toner, transfer onto a transfer material such as paper, and cleaning of residual toner because these external forces are directly applied to the surface of the electrophotographic photosensitive member. Specifically, the electrophotographic photosensitive member needs to have durability against generation of a flaw or wear on the surface due to slide friction, durability against surface deterioration due to charging such as a reduction in transfer efficiency or in smoothness, and durability against deterioration of electrical properties such as a reduction in sensitivity and a reduction in potential.

Electrophotographic photosensitive members each using an organic material as a photoconductive substance (such as a charge generating substance or a charge transporting substance), so-called organic electrophotographic photosensitive members are prevalent as electrophotographic photosensitive members because of their advantages including a low cost and high productivity. The dominating organic electrophotographic photosensitive member is an electrophotographic photosensitive member having a so-called laminated type photosensitive layer, which is obtained by laminating a charge generating layer containing a charge generating substance such as a photoconductive dye or a photoconductive pigment and a charge transporting layer containing a charge transporting substance such as a photoconductive polymer or a photoconductive low molecular weight compound.

An organic electrophotographic photosensitive member is generally provided with a layer obtained by molecularly dispersing a photoconductive substance into a binder resin as a surface layer (layer placed at the outermost surface of the electrophotographic photosensitive member). The mechanical strength (durability against electrical and/or mechanical external forces) of the surface of such an electrophotographic photosensitive member depends on the mechanical strength of the binder resin in the surface layer.

It can be hardly said that the mechanical strength of the surface of a conventional electrophotographic photosensitive member is sufficient for recent demands for higher image quality and longer service life. The reason for this is as follows. When the surface layer of an electrophotographic photosensitive member is formed with a composition intended for higher sensitivity in order to achieve higher image quality, a flaw or wear generates on the surface of the electrophotographic photosensitive member owing to slide friction of an abutting member (such as a charging member, a developing member, a transferring member, or a cleaning member) upon repeated use of the electrophotographic photosensitive member. When the surface layer of an electrophotographic photosensitive member is formed with a composition intended for ensuring scratch resistance and wear resistance in order to achieve longer service life, sensitivity reduces or a rest potential increases to make it impossible to obtain satisfactory electrophotographic properties. Moreover, if a flaw or wear generates on the surface of an electrophotographic photosensitive member, the degree of roughness of the surface increases to change the capacity of the electrophotographic photosensitive member in a minute range, thereby resulting in a reduction in uniformity of sensitivity.

To solve the above problems, JP 02-127652 A discloses a technique in which a specific curing resin is used as a binder resin for a charge transporting layer to serve as a surface layer. In addition, JP 05-216249 A and JP 07-072640 A each disclose a technique in which a curing film obtained by curing a monomer having a carbon-carbon double bond with heat or light energy is used for a surface layer of an electrophotographic photosensitive member.

However, the electrophotographic photosensitive members disclosed in those publications are susceptible to improvement from the viewpoint of compatibility between the sensitivity and the mechanical strength of the surface.

By the way, a "hardness" is one measure of the degree of mechanical deterioration of the surface of an electrophotographic photosensitive member. Attempts have been made to quantitatively convert the hardness into a number. Examples of such attempts include a scratch hardness test, a pencil hardness test, and a Vickers hardness test. A hardness represented by each of those tests is one obtained by quantitatively converting a deformation amount of a surface layer of an electrophotographic photosensitive member into a number.

However, according to those tests, in some cases, a flaw or wear generates more easily in an electrophotographic photosensitive member showing a higher surface hardness than in an electrophotographic photosensitive member showing a lower surface hardness, or a flaw generates although wear hardly generates. In other words, it cannot be said that there is always a correlation between a surface hardness represented by the scratch hardness test, the pencil hardness test, the Vickers hardness test, or the like and the mechanical strength of the surface of an electrophotographic photosensitive member. Deformations can be classified into a plastic deformation and an elastic deformation. It is probably impossible to express the hardness in terms of the total deformation amount alone without taking the kind of deformation into consideration.

SUMMARY OF THE INVENTION

The present invention has been made in order to solve the above problems, and therefore an object of the present invention is to provide an electrophotographic photosensitive member which maintains high sensitivity even if it is used repeatedly, and on the surface of which a flaw or wear hardly generates. Another object of the present invention is to provide a process cartridge and an electrophotographic apparatus each having the electrophotographic photosensitive member.

The inventors of the present invention have made extensive studies to find that an electrophotographic photosensitive member the surface of which has a universal hardness and an elastic deformation ratio each in a certain range can solve the above problems, thereby completing the present invention.

That is, the present invention is as follows.

(1) An electrophotographic photosensitive member comprising a support and a photosensitive layer on the support, wherein a surface of the electrophotographic photosensitive member has a universal hardness (HU) in the range of between 150 and 220 N/mm$^2$ and an elastic deformation ratio in the range of between 50 and 65%.

(2) The electrophotographic photosensitive member according to the item (1), wherein the surface of the electrophotographic photosensitive member has a universal hardness (HU) in the range of between 160 and 200 N/mm$^2$.

(3) The electrophotographic photosensitive member according to the item (1), wherein a surface layer of the electrophotographic photosensitive member is a layer formed by polymerizing a hole-transporting compound having a chain polymerizable functional group.

(4) The electrophotographic photosensitive member according to the item (3), wherein the hole-transporting compound having a chain polymerizable functional group comprises a hole-transporting compound having 2 or more chain polymerizable functional groups.

(5) The electrophotographic photosensitive member according to the item (3), wherein the hole-transporting compound having a chain polymerizable functional group has at least one group of an acryloyloxy group and a methacryloyloxy group as the chain polymerizable functional group.

(6) The electrophotographic photosensitive member according to the item (3), wherein the surface layer of the electrophotographic photosensitive member comprises a layer formed by polymerizing the hole-transporting compound having a chain polymerizable functional group by using radiation.

(7) The electrophotographic photosensitive member according to the item (6), wherein the radiation is an electron beam.

(8) A process cartridge comprising an electrophotographic photosensitive member and at least one means selected from the group consisting of charging means, developing means, transferring means, and cleaning means which are integrally supported, and being detachably mountable to a main body of an electrophotographic apparatus, wherein the electrophotographic photosensitive member has a support and a photosensitive layer on the support; and a surface of the electrophotographic photosensitive member has a universal hardness (HU) in a range of between 150 and 220 N/mm$^2$ and an elastic deformation ratio in a range of between 50 and 65%.

(9) An electrophotographic apparatus comprising an electrophotographic photosensitive member, charging means, exposure means, developing means and transferring means, wherein the electrophotographic photosensitive member has a support and a photosensitive layer on the support; and a surface of the electrophotographic photosensitive member has a universal hardness (HU) in a range of between 150 and 220 N/mm$^2$ and an elastic deformation ratio in a range of between 50 and 65%.

DETAILED DESCRIPTION OF THE INVENTION

Figure 1:
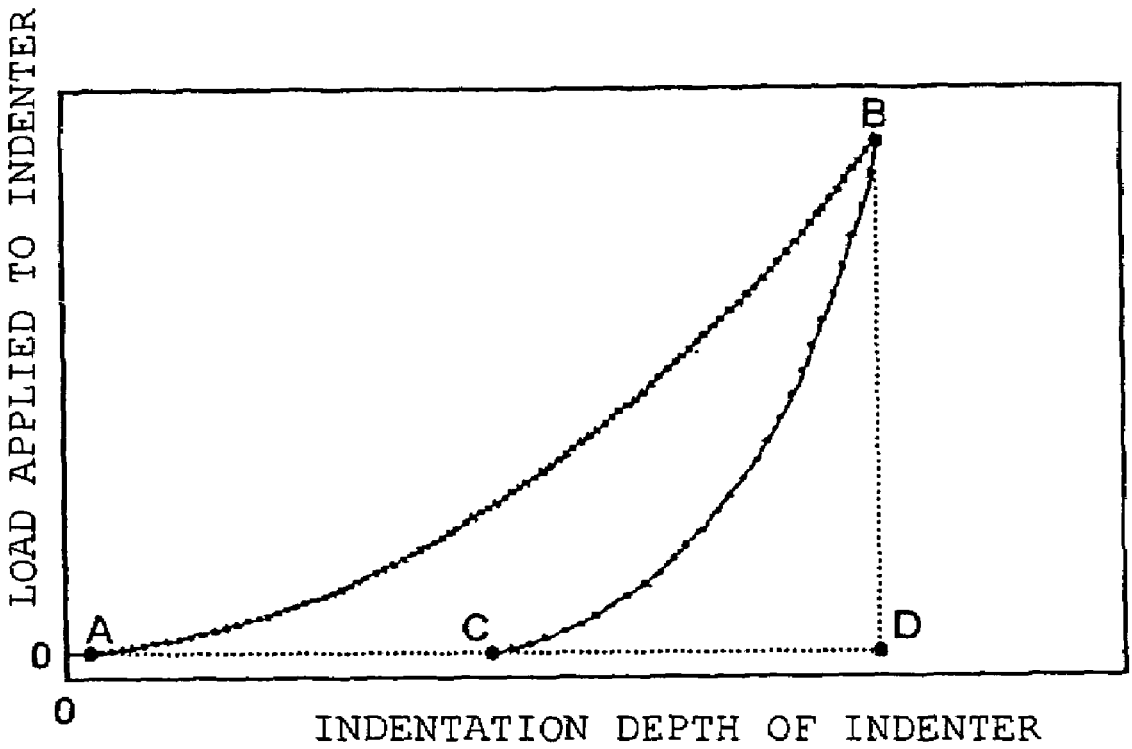
FIG. 1 is a diagram showing an outline of an output chart of a FISCHERSCOPE H100V (manufactured by Fischer).

Hereinafter, the present invention will be described in detail.

As described above, the surface of the electrophotographic photosensitive member of the present invention has a universal hardness (HU) in the range of between 150 and 220 N/mm$^2$ and an elastic deformation ratio in the range of between 50 and 65% in a 25° C./50% RH environment. In particular, the universal hardness (HU) is preferably in the range of between 160 and 200 N/mm$^2$.

When the universal hardness (HU) is excessively large or the elastic deformation ratio is excessively small, the electrophotographic photosensitive member surface has an insufficient elastic force. Consequently, paper powder or toner sandwiched between the electrophotographic photosensitive member and an abutting member such as a charging member or a cleaning member rubs the electrophotographic photosensitive member surface to facilitate generation of a flaw on the electrophotographic photosensitive member surface. Wear generation is also facilitated in association with the fact. When the universal hardness (HU) is excessively large, an elastic deformation amount becomes small even if the elastic deformation ratio is large. As a result, a large pressure is applied to a local area of the electrophotographic photosensitive member surface, thereby facilitating generation of a deep flaw on the electrophotographic photosensitive member surface. In other words, an electrophotographic photosensitive member having large surface hardnesses (including hardnesses deduced from the scratch hardness test, the pencil hardness test, the Vickers hardness test, and the like as well as the universal hardness (HU)) is not always preferable.

When the elastic deformation ratio is excessively large, a plastic deformation amount becomes large even if the universal hardness (HU) falls within the above range. Consequently, paper powder or toner sandwiched between the electrophotographic photosensitive member and an abutting member such as a charging member or a cleaning member rubs the electrophotographic photosensitive member surface to facilitate generation of a fine flaw on the electrophotographic photosensitive member surface. Wear generation is also facilitated.

When the elastic deformation ratio is excessively small, the plastic deformation amount becomes relatively large even if the universal hardness (HU) falls within the above range. Consequently, generation of a fine flaw on the electrophotographic photosensitive member surface is facilitated. Wear generation is also facilitated. This phenomenon is particularly remarkable in the case, not only, where the elastic deformation ratio is excessively small, but, where the universal hardness (HU) is also excessively small.

In the present invention, the universal hardness (HU) and elastic deformation ratio of the electrophotographic photosensitive member surface are measured by using a microhardness measuring device FISCHERSCOPE H100V (manufactured by Fischer) in a 25° C./50% RH environment. The FISCHERSCOPE H100V determines a continuous hardness by: bringing an indenter into abutment with a measuring object (the electrophotographic photosensitive member surface); continuously applying a load to the indenter; and directly reading an indentation depth under a load.

The indenter used in the present invention was a Vickers square cone diamond indenter with an angle between the opposite faces of 136°. The final value of the load to be continuously applied to the indenter (final load) was 6 mN. A time period (retention time) during which the indenter was kept under the final load of 6 mN was 0.1 second. The number of points of measurement was 273.

Figure 2:
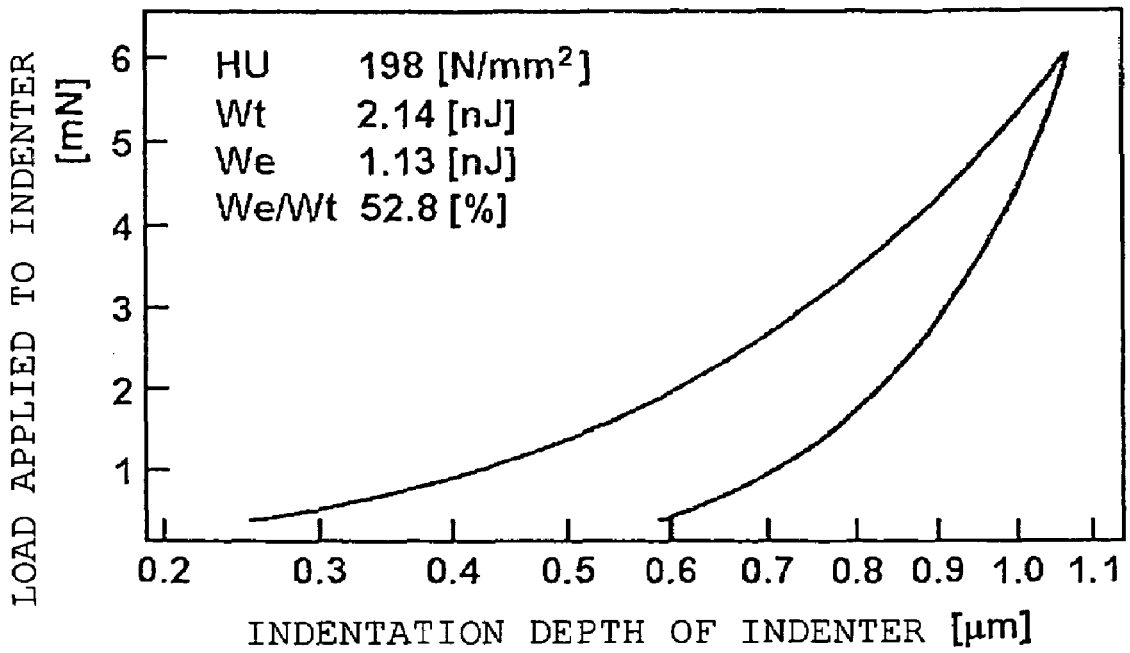
FIG. 2 is a diagram showing an example of an output chart of the FISCHERSCOPE H100V (manufactured by Fischer) when an electrophotographic photosensitive member of the present invention is used as a measuring object.

FIG. 1 shows an outline of an output chart of the FISCHERSCOPE H100V (manufactured by Fischer). In addition, FIG. 2 shows an example of an output chart of the FISCHERSCOPE H100V (manufactured by Fischer) when the electrophotographic photosensitive member of the present invention is used as a measuring object. In each of FIGS. 1 and 2, the axis of ordinate indicates a load F (mN) applied to an indenter whereas the axis of abscissa indicates an indentation depth h (μm) of the indenter. FIG. 1 shows the result obtained in the case where a load applied to the indenter is increased stepwise to reach the maximum (A→B), and is then reduced stepwise (B→C). FIG. 2 shows the result obtained in the case where a load applied to the indenter is increased stepwise to finally reach 6 mN, and is then reduced stepwise.

The universal hardness (HU) can be determined from the indentation depth of the indenter under the final load of 6 mN by using the following equation. In the following equation, HU means the universal hardness, $F_f$ means the final load, $S_f$ means the surface area of an indented part of the indenter under the final load, and $h_f$ means the indentation depth of the indenter under the final load.

$$HU = \frac{F_f[\mathrm{N}]}{S_f[\mathrm{mm}^2]} = \frac{6\times10^{-3}}{26.43\times(h_f\times10^{-3})^2}$$

In addition, the elastic deformation ratio can be determined from a change in work dose (energy) on the measuring object (the electrophotographic photosensitive member surface) by the indenter, that is, a change in energy due to an increase or decrease in load of the indenter to the measuring object (the electrophotographic photosensitive member surface). Specifically, dividing an elastic deformation work dose We by the total work dose Wt (We/Wt) yields the elastic deformation ratio. The total work dose Wt corresponds to the area of a region surrounded by A-B-D-A of FIG. 1 whereas the elastic deformation work dose We corresponds to the area of a region surrounded by C-B-D-C of FIG. 1.

Hereinafter, the electrophotographic photosensitive member of the present invention will be described in detail. The following description includes a method of manufacturing the electrophotographic photosensitive member.

To obtain an electrophotographic photosensitive member the surface of which has a universal hardness (HU) and an elastic deformation ratio in the above ranges, it is effective to form a surface layer of the electrophotographic photosensitive member by polymerizing a hole-transporting compound having a chain polymerizable functional group. It is particularly effective to form the surface layer by polymerizing and cross-linking a hole-transporting compound having 2 or more chain polymerizable functional groups (in the same molecule). The surface layer of the electrophotographic photosensitive member means a layer placed at the outermost surface of the electrophotographic photosensitive member, in other words, a layer placed at a position separated most from a support.

First, a method of forming a surface layer by using a hole-transporting compound having a chain polymerizable functional group is described more specifically.

The surface layer can be formed by: coating a coating liquid for a surface layer containing a hole-transporting compound having a chain polymerizable functional group, a solvent, and, further a binder resin as required; and polymerizing (and cross-linking) the hole-transporting compound having a chain polymerizable functional group to cure the coated coating liquid for a surface layer.

In coating the coating liquid for a surface layer, coating methods such as a dip coating method, a spray coating method, a curtain coating method, and a spin coating method are available. Of those coating methods, the dip coating method and the spray coating method are preferable in terms of efficiency and productivity.

Examples of a method of polymerizing (and cross-linking) a hole-transporting compound having a chain polymerizable functional group include a method in which heat, light such as visible light or ultraviolet light, or radiation such as an electron beam or a γ ray is used. The coating liquid for a surface layer may also contain a polymerization initiator as required.

A method in which radiation such as an electron beam or a γ ray, in particular an electron beam, is used is preferable as a method of polymerizing (and cross-linking) a hole-transporting compound having a chain polymerizable functional group. This is because polymerization by using radiation requires no particular polymerization initiator. A 3-dimensional matrix surface layer with an extremely high purity can be formed by polymerizing (and cross-linking) a hole-transporting compound having a chain polymerizable functional group without using a polymerization initiator. In this case, an electrophotographic photosensitive member exhibiting good electrophotographic properties can be obtained. In addition, polymerization by using an electron beam out of radiation enables good electrophotographic properties to be exerted because damage to an electrophotographic photosensitive member due to irradiation is extremely small.

It is important to take the conditions for electron beam irradiation into consideration in order to obtain the electrophotographic photosensitive member of the present invention having a universal hardness (HU) and an elastic deformation ratio in the above ranges by polymerizing (and cross-linking) a hole-transporting compound having a chain polymerizable functional group through electron beam irradiation.

Scanning-type, electrocurtain-type, broad beam-type, pulse-type, and laminar-type accelerators, and other types of accelerators can be used for electron beam irradiation. An accelerating voltage is preferably 250 kV or less, particularly preferably 150 kV or less. An irradiation dose is preferably in the range of 0.1 to 100 Mrad, particularly preferably in the range of 0.5 to 20 Mrad. An excessively large accelerating voltage or an excessively large irradiation dose may deteriorate the electrical properties of the electrophotographic photosensitive member. An excessively small irradiation dose may insufficiently polymerize (and cross-link) the hole-transporting compound having a chain polymerizable functional group, thereby leading to insufficient curing of the coating liquid for a surface layer.

In addition, to promote curing of the coating liquid for a surface layer, an irradiated body (which is irradiated with an electron beam) is preferably heated upon polymerization (and cross-linking) of the hole-transporting compound having a chain polymerizable functional group by using an electron beam. The irradiated body may be heated before, during, or after the electron beam irradiation. However, the irradiated body preferably has a constant temperature as long as a radical of the hole-transporting compound having a chain polymerizable functional group is present. When the temperature at which the irradiated body is heated is excessively high, a material for the electrophotographic photosensitive member may be deteriorated. Therefore, the irradiated body is heated in such a manner that the temperature of the irradiated body is kept preferably at 140° C. or less, particularly preferably is 110° C. or less. On the other hand, when the temperature at which the irradiated body is heated is excessively low, the heating provides a poor effect. Therefore, the irradiated body is heated in such a manner that the temperature of the irradiated body is kept preferably at 50° C. or more, particularly preferably is 80° C. or more. The heating time is preferably 5 minutes to 30 minutes, specifically preferably 10 minutes to 30 minutes. When the heating time is excessively short, the heating provides a poor effect.

The electron beam irradiation and the heating of the irradiated body may be performed in the atmosphere, in an inert gas (such as nitrogen or helium) atmosphere, or in a vacuum. However, the irradiation and the heating are preferably performed in an inert gas atmosphere or in a vacuum because radical deactivation due to oxygen can be suppressed.

In addition, the surface layer of the electrophotographic photosensitive member has a thickness of preferably 30 μm or less, more preferably 20 μm or less, further preferably 10 μm or less, still further preferably 7 μm or less from the viewpoint of electrophotographic properties. On the other hand, the surface layer has a thickness of preferably 0.5 μm or more, more preferably 1 μm or more from the viewpoint of durability of the electrophotographic photosensitive member.

By the way, in the present invention, the term "hole-transporting compound having a chain polymerizable functional group" refers to a hole-transporting compound with part of the molecules chemically bonded to a chain polymerizable functional group.

Polymerization reaction forms of production reactions for polymers can be roughly classified into chain polymerization and successive polymerization. The former is now taken into consideration. Specifically, the chain polymerization refers to unsaturated polymerization, ring-opening polymerization, or isomerization polymerization which proceeds mainly via an intermediate such as a radical or an ion.

A chain polymerizable functional group means a functional group that can perform the chain polymerization. Shown below are examples of an unsaturated polymerizable functional group and a ring-opening polymerizable functional group which can find use in a variety of applications.

Unsaturated polymerization is a reaction in which radicals, ions, and the like cause unsaturated groups such as C═C, C≡C, C═O, C═N, and C≡N (mainly C═C of those) to polymerize. Specific examples of an unsaturated polymerizable functional group are shown below.

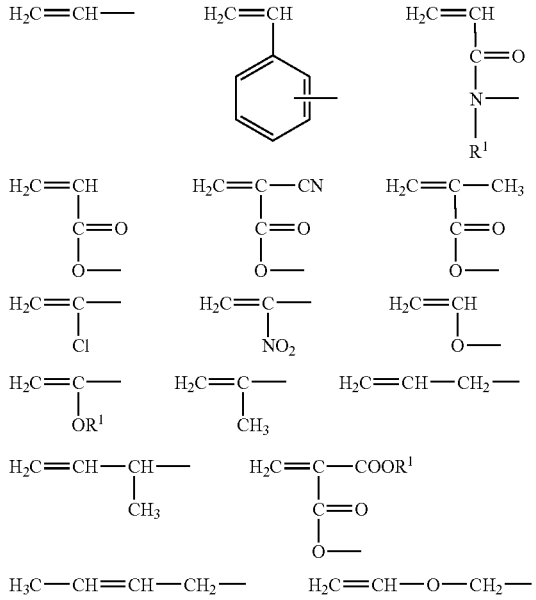

In the above formulae, $R^1$ represents a hydrogen atom, a substituted or unsubstituted alkyl group, a substituted or unsubstituted aryl group, a substituted or unsubstituted aralkyl group, or the like. Examples of the alkyl group include a methyl group, an ethyl group, and a propyl group. Examples of the aryl group include a phenyl group, a naphthyl group, and an anthryl group. Examples of the aralkyl group include a benzyl group and a phenethyl group.

Ring-opening polymerization is a reaction in which asymmetric and unstable cyclic structures such as a carbocyclic structure, an oxocyclic structure, and a nitrogen heterocyclic structure undergo ring-opening and, at the same time, repeat polymerization to produce a chain polymer. In most cases, ions act as active species. Specific examples of a ring-opening polymerizable functional group are shown below.

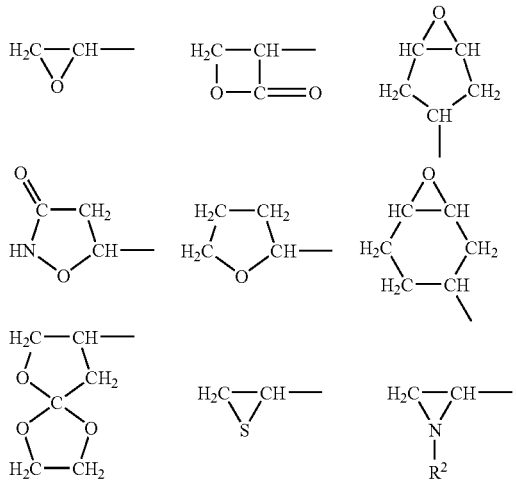

-continued

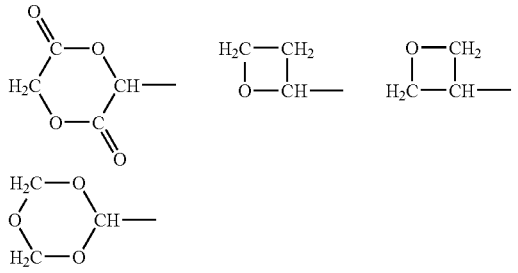

In the above formulae, $R^2$ represents a hydrogen atom, a substituted or unsubstituted alkyl group, a substituted or unsubstituted aryl group, a substituted or unsubstituted aralkyl group, or the like. Examples of the alkyl group include a methyl group, an ethyl group, and a propyl group. Examples of the aryl group include a phenyl group, a naphthyl group, and an anthryl group. Examples of the aralkyl group include a benzyl group and a phenethyl group.

Of the chain polymerizable functional groups exemplified above, chain polymerizable functional groups having structures represented by the following formulae (1) to (3) are preferable.

(1)

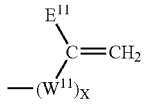

In the formula (1), $E^{11}$ represents a hydrogen atom, a halogen atom, a substituted or unsubstituted alkyl group, a substituted or unsubstituted aryl group, a substituted or unsubstituted aralkyl group, a substituted or unsubstituted alkoxy group, a cyano group, a nitro group, —$COOR^{11}$, or —$CONR^{12}R^{13}$. $W^{11}$ represents a substituted or unsubstituted alkylene group, a substituted or unsubstituted arylene group, —COO—, —O—, —OO—, —S—, or $CONR^{14}$—. $R^{11}$ to $R^{14}$ each independently represent a hydrogen atom, a halogen atom, a substituted or unsubstituted alkyl group, a substituted or unsubstituted aryl group, or a substituted or unsubstituted aralkyl group. The subscript X represents 0 or 1. Examples of the halogen atom include a fluorine atom, a chlorine atom, and a bromine atom. Examples of the alkyl group include a methyl group, an ethyl group, a propyl group, and a butyl group. Examples of the aryl group include a phenyl group, a naphthyl group, an anthryl group, a pyrenyl group, a thiophenyl group, and a furyl group. Examples of the aralkyl group include a benzyl group, a phenethyl group, a naphthylmethyl group, a furfuryl group, and a thienyl group. Examples of the alkoxy group include a methoxy group, an ethoxy group, and a propoxy group. Examples of the alkylene group include a methylene group, an ethylene group, and a butylene group. Examples of the arylene group include a phenylene group, a naphthylene group, and an anthracenylene group.

Examples of a substituent which each of the above groups may have include: halogen atoms such as a fluorine atom, a chlorine atom, a bromine atom, and an iodine atom; alkyl groups such as a methyl group, an ethyl group, a propyl group, and a butyl group; aryl groups such as a phenyl group, a naphthyl group, an anthryl group, and a pyrenyl group; aralkyl groups such as a benzyl group, a phenethyl group, a naphthylmethyl group, a furfuryl group, and a thienyl group; alkoxy groups such as a methoxy group, an ethoxy group, and a propoxy group; aryloxy groups such as a phenoxy group and a naphthoxy group; a nitro group; a cyano group; and a hydroxyl group.

(2)

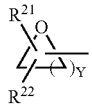

In the formula (2), $R^{21}$ and $R^{22}$ each independently represent a hydrogen atom, a substituted or unsubstituted alkyl group, a substituted or unsubstituted aryl group, or a substituted or unsubstituted aralkyl group. The subscript Y represents an integer of 1 to 10. Examples of the alkyl group include a methyl group, an ethyl group, a propyl group, and a butyl group. Examples of the aryl group include a phenyl group and a naphthyl group. Examples of the aralkyl group include a benzyl group and a phenethyl group.

Examples of a substituent which each of the above groups may have include: halogen atoms such as a fluorine atom, a chlorine atom, a bromine atom, and an iodine atom; alkyl groups such as a methyl group, an ethyl group, a propyl group, and a butyl group; aryl groups such as a phenyl group, a naphthyl group, an anthryl group, and a pyrenyl group; aralkyl groups such as a benzyl group, a phenethyl group, a naphthylmethyl group, a furfuryl group, and a thienyl group; alkoxy groups such as a methoxy group, an ethoxy group, and a propoxy group; and aryloxy groups such as a phenoxy group and a naphthoxy group.

(3)

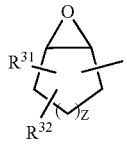

In the formula (3), $R^{31}$ and $R^{32}$ each independently represent a hydrogen atom, a substituted or unsubstituted alkyl group, a substituted or unsubstituted aryl group, or a substituted or unsubstituted aralkyl group. The subscript Z represents an integer of 0 to 10. Examples of the alkyl group include a methyl group, an ethyl group, a propyl group, and a butyl group. Examples of the aryl group include a phenyl group and a naphthyl group. Examples of the aralkyl group include a benzyl group and a phenethyl group.

Examples of a substituent which each of the above groups may have include: halogen atoms such as a fluorine atom, a chlorine atom, a bromine atom, and an iodine atom; alkyl groups such as a methyl group, an ethyl group, a propyl group, and a butyl group; aryl groups such as a phenyl group, a naphthyl group, an anthryl group, and a pyrenyl group; aralkyl groups such as a benzyl group, a phenethyl group, a naphthylmethyl group, a furfuryl group, and a thienyl group; alkoxy groups such as a methoxy group, an ethoxy group, and a propoxy group; and aryloxy groups such as a phenoxy group and a naphthoxy group.

Of the chain polymerizable functional groups having the structures represented by the above formulae (1) to (3), chain polymerizable functional groups having structures represented by the following formulae (P-1) to (P-11) are more preferable.

(P-1)

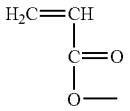

(P-2)

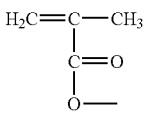

(P-3)

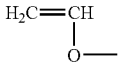

(P-4)

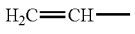

(P-5)

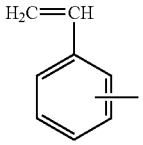

(P-6)

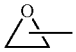

(P-7)

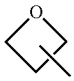

(P-8)

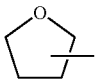

(P-9)

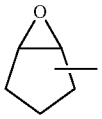

(P-10)

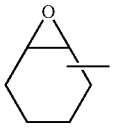

(P-11)

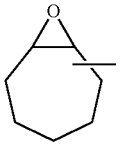

Of the chain polymerizable functional groups having the structures represented by the above formulae (P-1) to (P-11), the chain polymerizable functional group having the structure represented by the above formula (P-1) (that is, an acryloyloxy group) and the chain polymerizable functional group having the structure represented by the above formula (P-2) (that is, a methacryloyloxy group) are still more preferable.

In the present invention, of the hole-transporting compounds having the above chain polymerizable functional groups, a hole-transporting compound having 2 or more chain polymerizable functional groups (in the same molecule) is preferable. Specific examples of the hole-transporting compound having 2 or more chain polymerizable functional groups are shown below.

$$(P^{41})_a—A^{41}—[R^{41}—(P^{42})_d]_b \quad (4)$$

In the above formula (4), $P^{41}$ and $P^{42}$ each independently represent a chain polymerizable functional group. $R^{41}$ represents a divalent group. $A^{41}$ represents a hole-transportable group. The subscripts a, b, and d each independently represent an integer of 0 or more provided that a+b×d is 2 or more. If a is 2 or more, a $P^{41}$'s may be identical to or different from each other. If b is 2 or more, b $[R^{41}—(P^{42})_d]$'s may be identical to or different from each other. If d is 2 or more, d $P^{42}$'s may be identical to or different from each other.

Examples of compounds obtained by substituting all of $(P^{41})_a$ and $[R^{41}—(P^{42})_d]_b$ in the above formula (4) by hydrogen atoms include oxazole derivatives, oxadiazole derivatives, imidazole derivatives, triarylamine derivatives (such as triphenylamine), 9-(p-diethylaminostyryl)-anthracene, 1,1-bis-(4-dibenzylaminophenyl)propane, styrylanthracene, styrylpyrazoline, phenylhydrazones, thiazole derivatives, triazole derivatives, phenazine derivatives, acridine derivatives, benzofuran derivatives, benzimidazole derivatives, thiophene derivatives, and N-phenylcarbazole derivatives. Of those compounds (obtained by substituting all of $(P^{41})_a$ and $[R^{41}—(P^{42})_d]_b$ in the above formula (4) by hydrogen atoms), a compound having a structure represented by the following formula (5) is preferable.

(5)

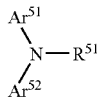

In the above formula (5), $R^{51}$ represents a substituted or unsubstituted alkyl group, a substituted or unsubstituted aryl group, or a substituted or unsubstituted aralkyl group. $Ar^{51}$ and $Ar^{52}$ each independently represent a substituted or unsubstituted aryl group. Each of $R^{51}$, $Ar^{51}$, and $Ar^{52}$ may be bonded to N (nitrogen atom) directly or via an alkylene group (such as a methyl group, an ethyl group, or a propylene group), a hetero atom (such as an oxygen atom or a sulfur atom), or —CH═CH—. The alkyl group is preferably one having 1 to 10 carbon atoms, and examples of such an alkyl group include a methyl group, an ethyl group, a propyl group, and a butyl group. Examples of the aryl group include a phenyl group, a naphthyl group, an anthryl group, a phenanthryl group, a pyrenyl group, a thiophenyl group, a furyl group, a pyridyl group, a quinolyl group, a benzoquinolyl group, a carbazolyl group, a phenothiadinyl group, a benzofuryl group, a benzothiophenyl group, a dibenzofuryl group, and a dibenzothiophenyl group. Examples of the aralkyl group include a benzyl group, a phenethyl group, a naphthylmethyl group, a furfuryl group, and a thienyl group. $R^{51}$ in the above formula (5) is preferably a substituted or unsubstituted aryl group.

Examples of a substituent which each of the above groups may have include: halogen atoms such as a fluorine atom, a chlorine atom, a bromine atom, and an iodine atom; alkyl groups such as a methyl group, an ethyl group, a propyl group, and a butyl group; aryl groups such as a phenyl group, a naphthyl group, an anthryl group, and a pyrenyl group; aralkyl groups such as a benzyl group, a phenethyl group, a naphthylmethyl group, a furfuryl group, and a thienyl group; alkoxy groups such as a methoxy group, an ethoxy group, and a propoxy group; aryloxy groups such as a phenoxy group and a naphthoxy group; substituted amino groups such as a dimethylamino group, a diethylamino group, a dibenzylamino group, a diphenylamino group, and a di(p-tolyl)amino group; arylvinyl groups such as a styryl group and a naphthylvinyl group; a nitro group; a cyano group; and a hydroxyl group.

Examples of the divalent group represented by $R^{41}$ in the above formula (4) include a substituted or unsubstituted alkylene group, a substituted or unsubstituted arylene group, $—CR^{411}=CR^{412}—$ ($R^{411}$ and $R^{412}$ each independently represent a hydrogen atom, a substituted or unsubstituted alkyl group, or a substituted or unsubstituted aryl group.), —CO—, —SO—, $—SO_2—$, an oxygen atom, a sulfur atom, and combinations of these. Of those, a divalent group having a structure represented by the following formula (6) is preferable, and a divalent group having a structure represented by the following formula (7) is more preferable.

$$—(X^{61})_{p6}—(Ar^{61})_{q6}—(X^{62})_{r6}—(Ar^{62})_{s6}—(X^{63})_{t6}— \quad (6)$$

$$—(X^{71})_{p7}—(Ar^{71})_{q7}—(X^{72})_{r7}— \quad (7)$$

In the above formula (6), $X^{61}$ to $X^{63}$ each independently represent a substituted or unsubstituted alkylene group, $—(CR^{61}=CR^{62})_{n6}—$ ($R^{61}$ and $R^{62}$ each independently represent a hydrogen atom, a substituted or unsubstituted alkyl group, or a substituted or unsubstituted aryl group. The subscript n6 represents an integer of 1 or more (preferably or 5 or less).), —CO—, —SO—, $—SO_2—$, an oxygen atom, or a sulfur atom. $Ar^{61}$ and $Ar^{62}$ each independently represent a substituted or unsubstituted arylene group. The subscripts p6, q6, r6, s6, and t6 each independently represent an integer of 0 or more (preferably 10 or less, more preferably 5 or less) provided that all of p6, q6, r6, s6, and t6 cannot be simultaneously 0. The alkylene group is preferably one having 1 to 20 carbon atoms, particularly preferably one having 1 to 10 carbon atoms, and examples of such an alkylene group include a methylene group, an ethylene group, and a propylene group. Examples of the arylene group include divalent groups each obtained by removing 2 hydrogen atoms from benzene, naphthalene, anthracene, phenanthrene, pyrene, benzothiophene, pyridine, quinoline, benzoquinoline, carbazole, phenothiazine, benzofuran, benzothiophene, dibenzofuran, dibenzothiophene, or the like. Examples of the alkyl group include a methyl group, an ethyl group, and a propyl group. Examples of the aryl group include a phenyl group, a naphthyl group, and a thiophenyl group.

Examples of a substituent which each of the above groups may have include: halogen atoms such as a fluorine atom, a chlorine atom, a bromine atom, and an iodine atom; alkyl groups such as a methyl group, an ethyl group, a propyl group, and a butyl group; aryl groups such as a phenyl group, a naphthyl group, an anthryl group, and a pyrenyl group; aralkyl groups such as a benzyl group, a phenethyl group, a naphthylmethyl group, a furfuryl group, and a thienyl group; alkoxy groups such as a methoxy group, an ethoxy group, and a propoxy group; aryloxy groups such as a phenoxy group and a naphthoxy group; substituted amino groups such as a dimethylamino group, a diethylamino group, a dibenzylamino group, a diphenylamino group, and a di(p-tolyl)amino group; arylvinyl groups such as a styryl group and a naphthylvinyl group; a nitro group; a cyano group; and a hydroxyl group.

In the above formula (7), $X^{71}$ and $X^{72}$ each independently represent a substituted or unsubstituted alkylene group, $—(CR^{71}=CR^{72})_{n7}—$ ($R^{71}$ and $R^{72}$ each independently represent a hydrogen atom, a substituted or unsubstituted alkyl group, or a substituted or unsubstituted aryl group. The subscript n7 represents an integer of 1 or more (preferably or 5 or less).), —CO—, or an oxygen atom. $Ar^{71}$ represents a substituted or unsubstituted arylene group. The subscripts p7, q7, and r7 each independently represent an integer of 0 or more (preferably 10 or less, more preferably 5 or less) provided that all of p7, q7, and r7 cannot be simultaneously 0. The alkylene group is preferably one having 1 to 20 carbon atoms, particularly preferably one having 1 to 10 carbon atoms, and examples of such an alkylene group include a methylene group, an ethylene group, and a propylene group. Examples of the arylene group include divalent groups each obtained by removing 2 hydrogen atoms from benzene, naphthalene, anthracene, phenanthrene, pyrene, benzothiophene, pyridine, quinoline, benzoquinoline, carbazole, phenothiazine, benzofuran, benzothiophene, dibenzofuran, dibenzothiophene, or the like. Examples of the alkyl group include a methyl group, an ethyl group, and a propyl group. Examples of the aryl group include a phenyl group, a naphthyl group, and a thiophenyl group.

Examples of a substituent which each of the above groups may have include: halogen atoms such as a fluorine atom, a chlorine atom, a bromine atom, and an iodine atom; alkyl groups such as a methyl group, an ethyl group, a propyl group, and a butyl group; aryl groups such as a phenyl group, a naphthyl group, an anthryl group, and a pyrenyl group; aralkyl groups such as a benzyl group, a phenethyl group, a naphthylmethyl group, a furfuryl group, and a thienyl group; alkoxy groups such as a methoxy group, an ethoxy group, and a propoxy group; aryloxy groups such as a phenoxy group and a naphthoxy group; substituted amino groups such as a dimethylamino group, a diethylamino group, a dibenzylamino group, a diphenylamino group, and a di(p-tolyl)amino group; arylvinyl groups such as a styryl group and a naphthylvinyl group; a nitro group; a cyano group; and a hydroxyl group.

Preferable examples (compound examples) of a hole-transporting compound having 2 or more chain polymerizable functional groups are shown below.

| No. | compound examples |
|---|---|
| 1 | 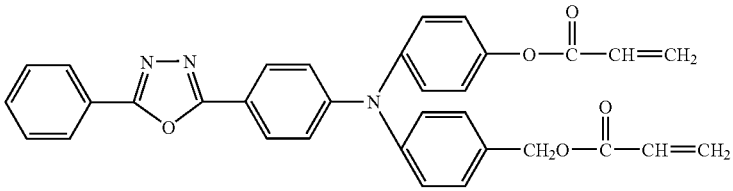 |

-continued
| No. | compound examples |
|---|---|
| 2 | 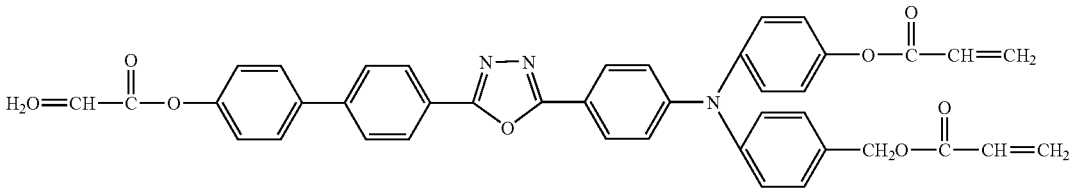 |
| 3 | 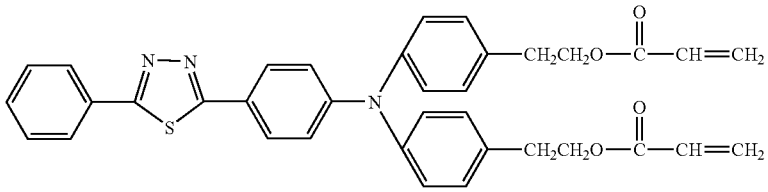 |
| 4 | 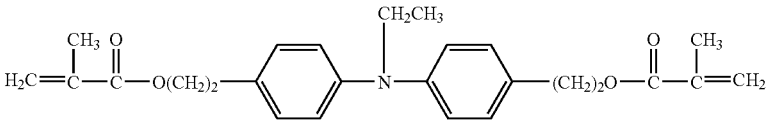 |
| 5 | 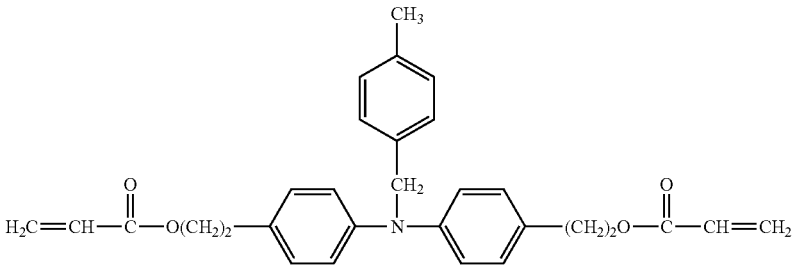 |
| 6 | 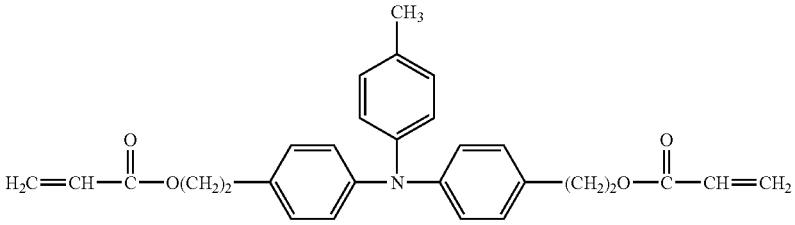 |
| 7 | 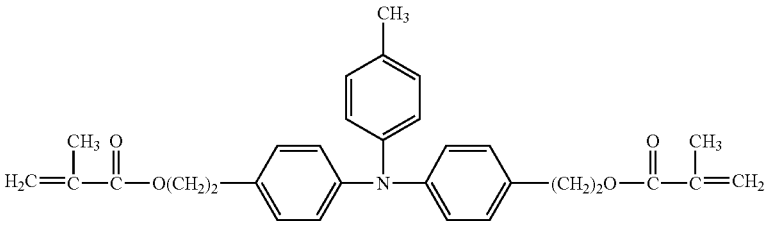 |
| 8 | 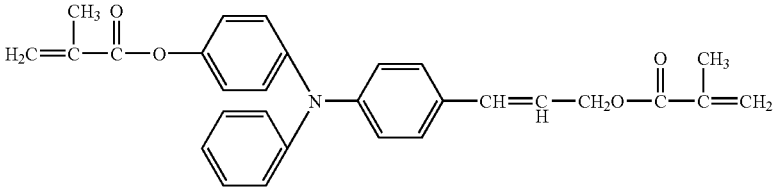 |

-continued
| No. | compound examples |
|---|---|
| 9 | 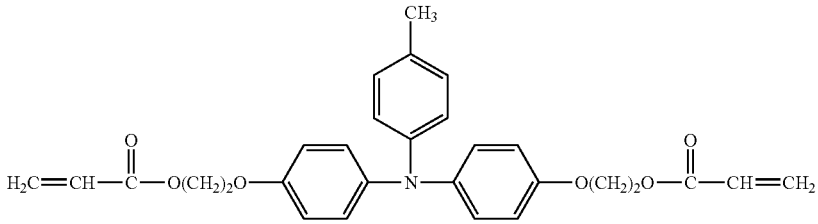 |
| 10 | 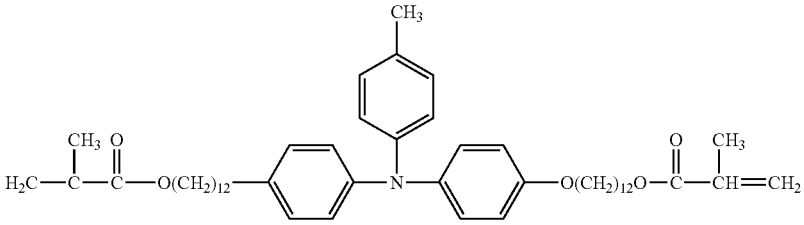 |
| 11 | 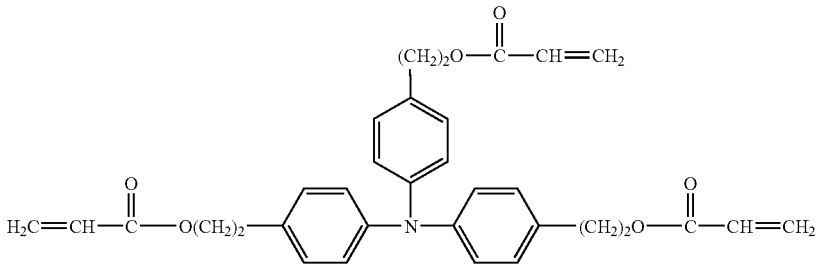 |
| 12 | 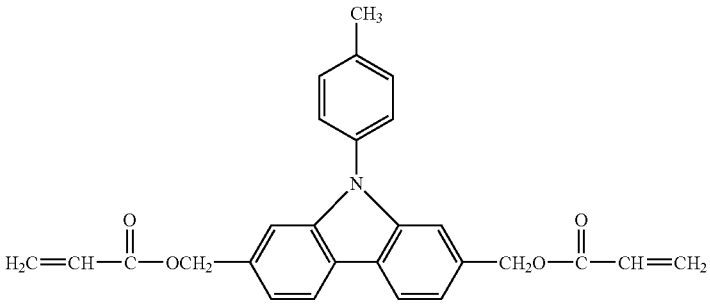 |
| 13 | 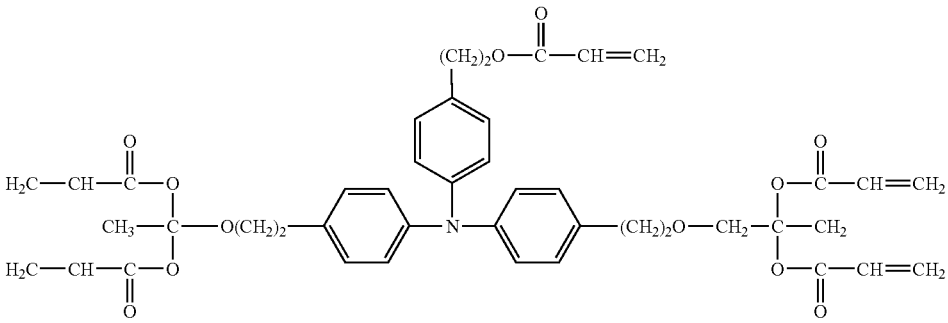 |

-continued
| No. | compound examples |
|---|---|
| 14 | 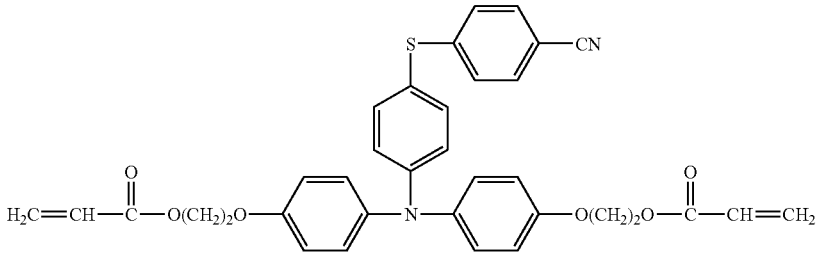 |
| 15 | 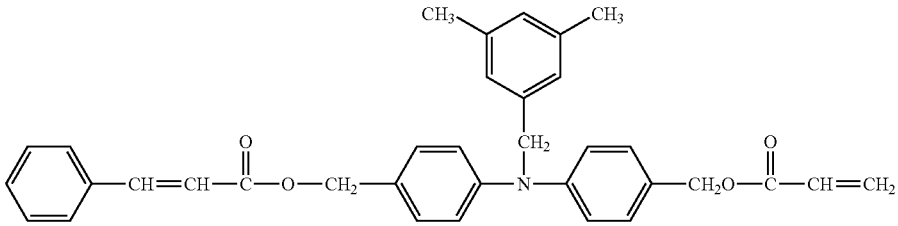 |
| 16 | 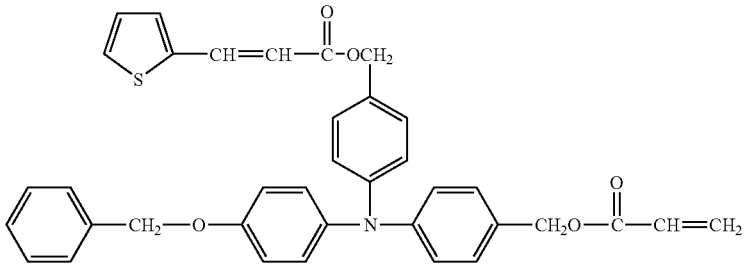 |
| 17 | 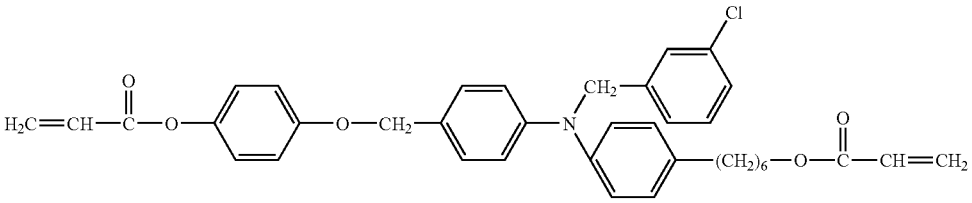 |
| 18 | 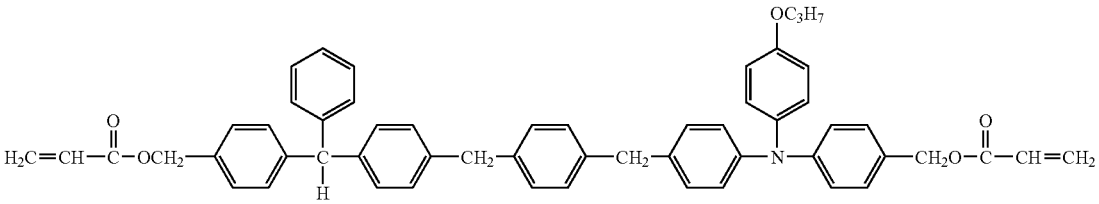 |
| 19 | 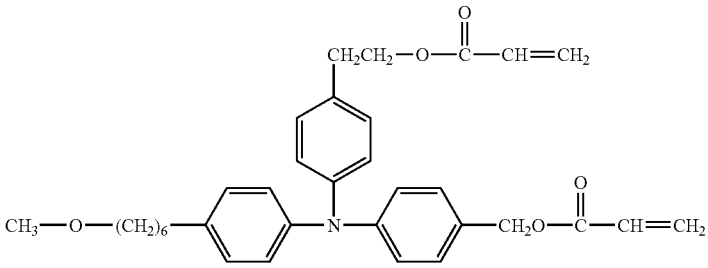 |

-continued
| No. | compound examples |
|---|---|
| 20 | 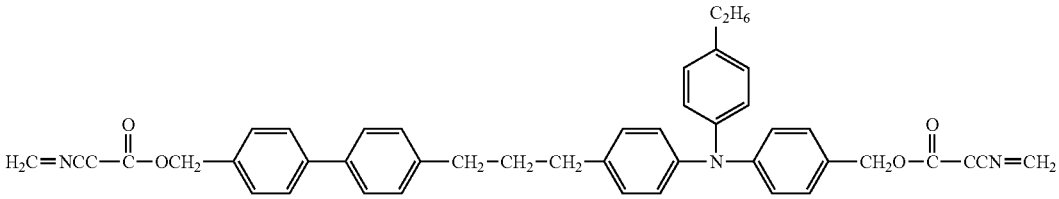 |
| 21 | 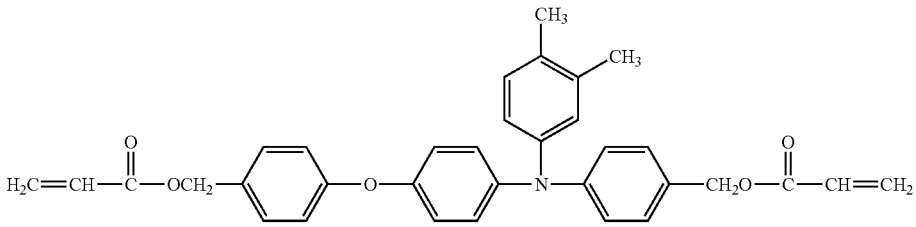 |
| 22 | 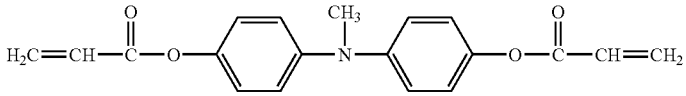 |
| 23 | 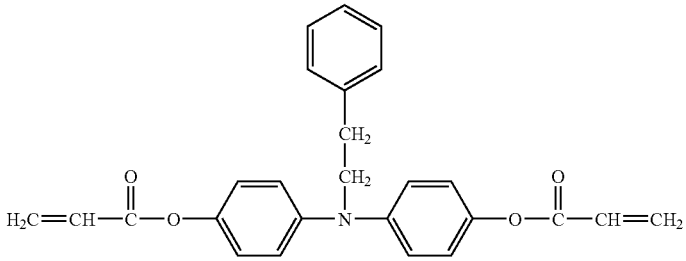 |
| 24 | 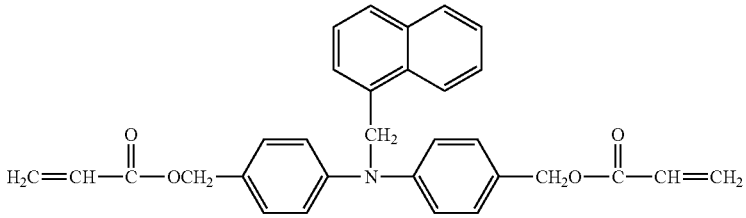 |
| 25 | 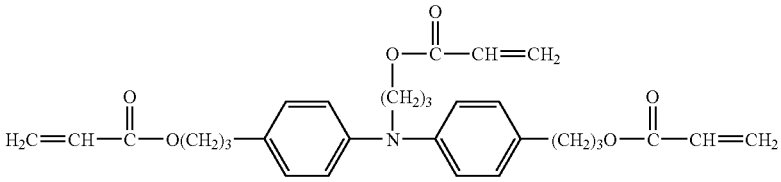 |
| 26 | 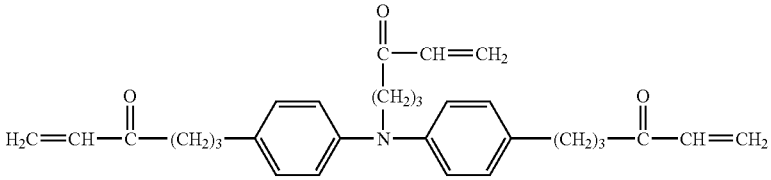 |

-continued
| No. | compound examples |
|---|---|
| 27 | 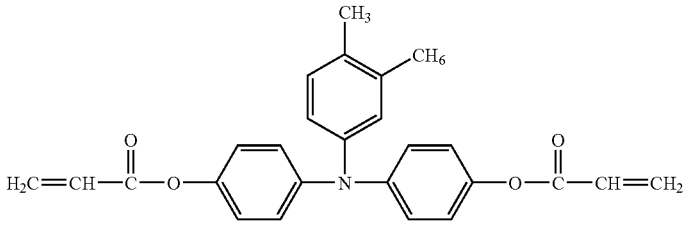 |
| 28 | 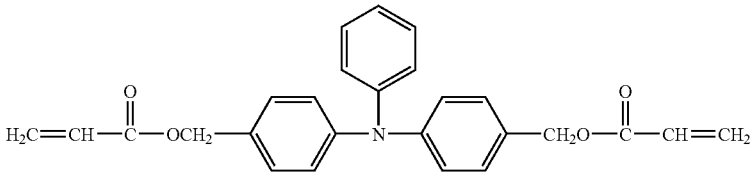 |
| 29 | 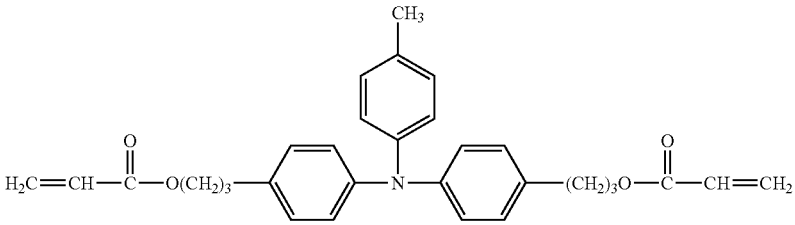 |
| 30 | 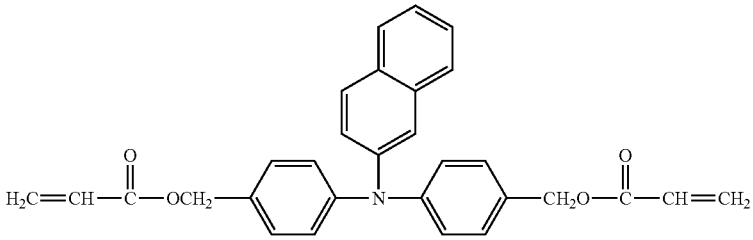 |
| 31 | 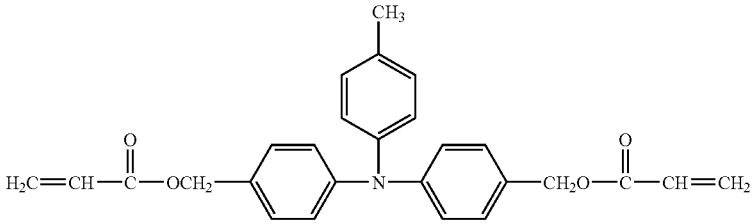 |
| 32 | 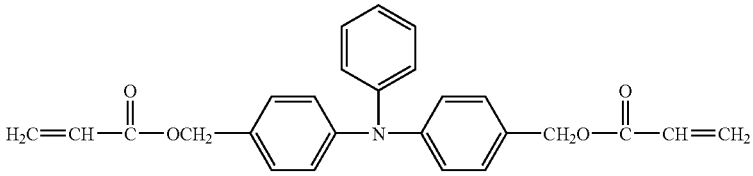 |
| 33 | 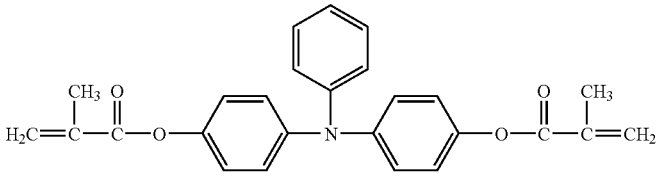 |

-continued
| No. | compound examples |
|---|---|
| 34 | 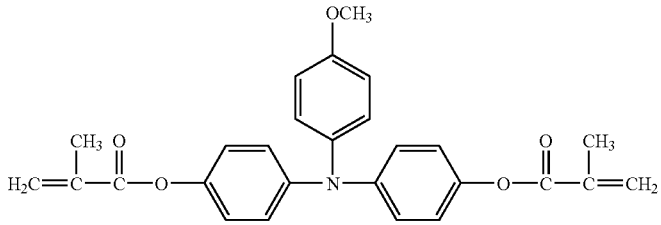 |
| 35 | 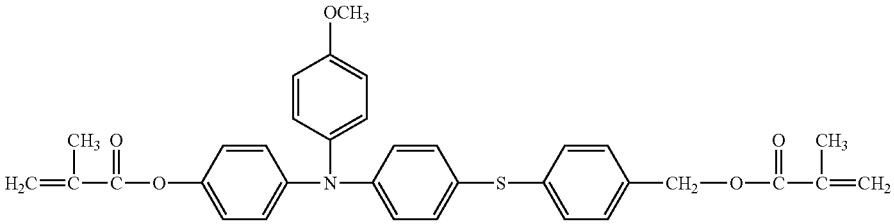 |
| 36 | 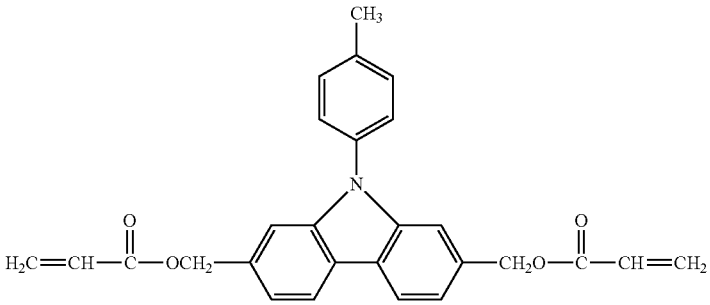 |
| 37 | 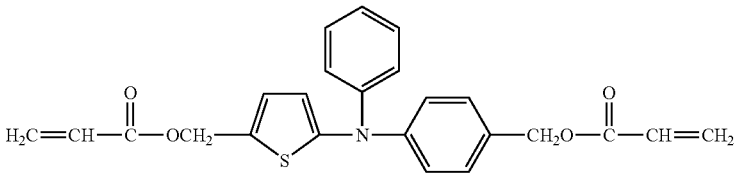 |
| 38 | 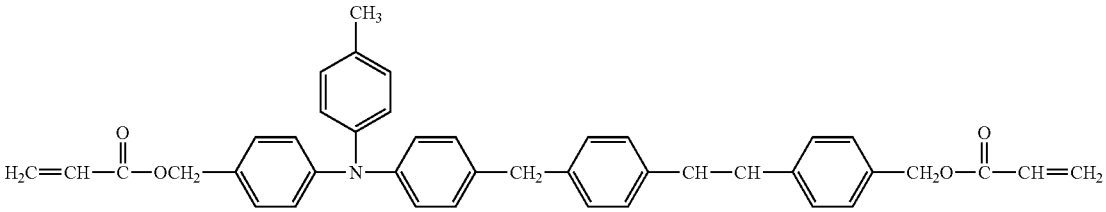 |
| 39 | 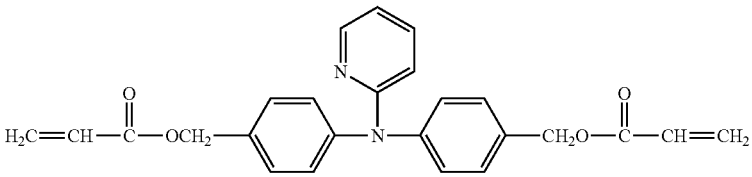 |

-continued
| No. | compound examples |
|---|---|
| 40 | 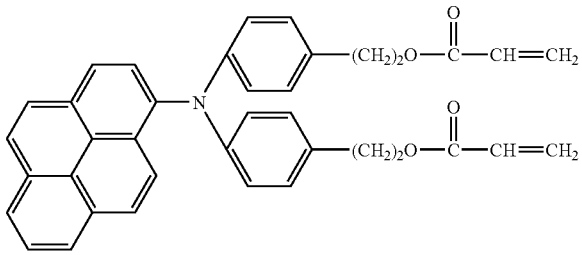 |
| 41 | 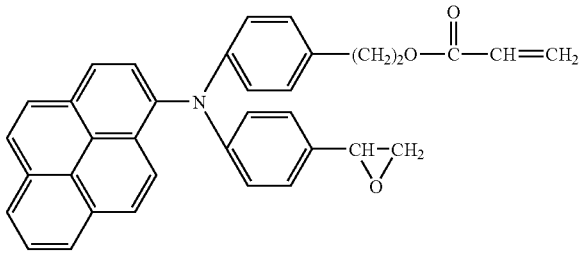 |
| 42 | 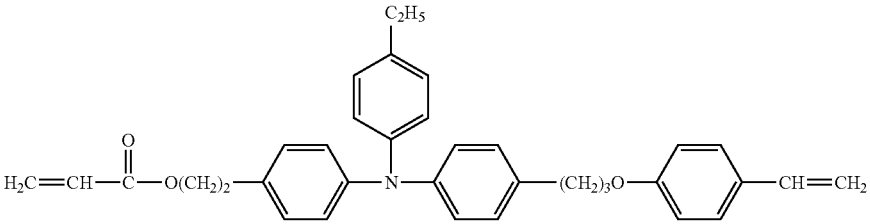 |
| 43 | 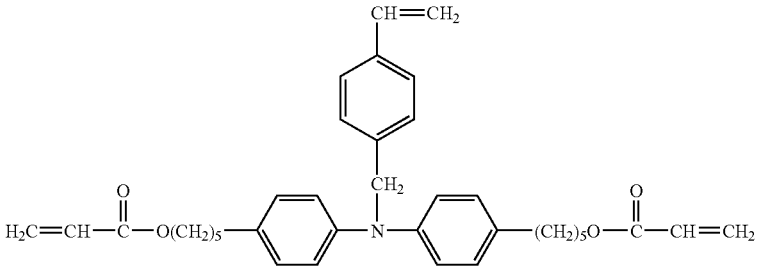 |
| 44 | 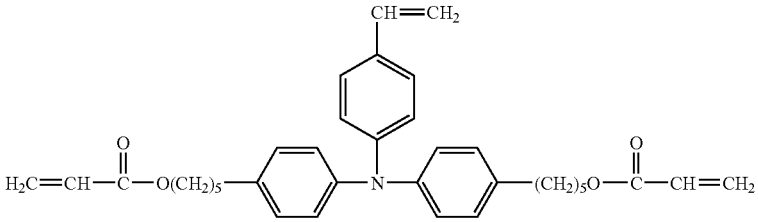 |
| 45 | 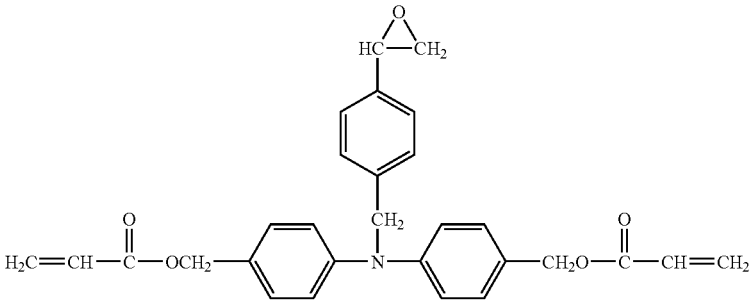 |

-continued
| No. | compound examples |
|---|---|
| 46 | 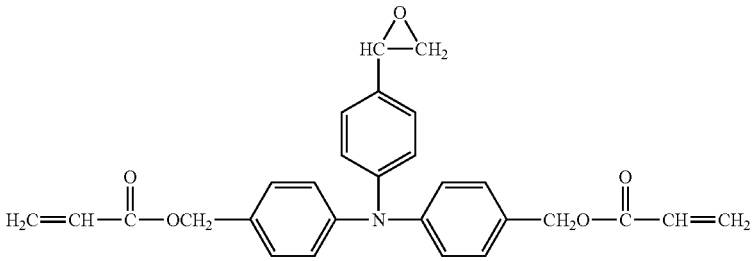 |
| 47 | 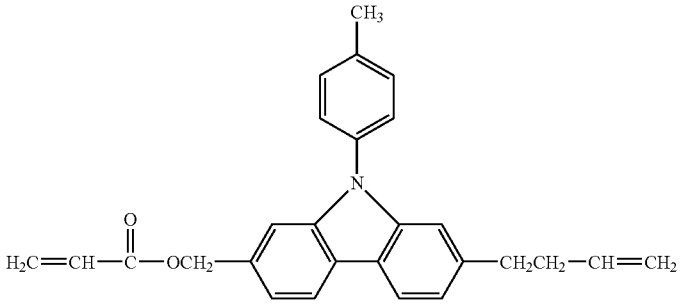 |
| 48 | 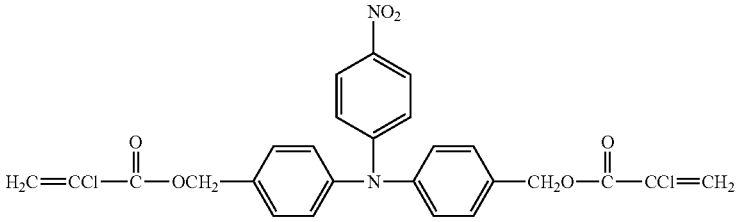 |
| 49 | 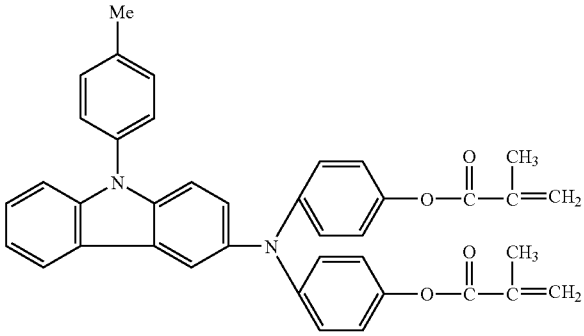 |
| 50 | 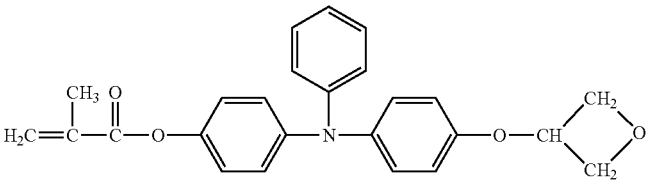 |

-continued
| No. | compound examples |
|---|---|
| 51 | 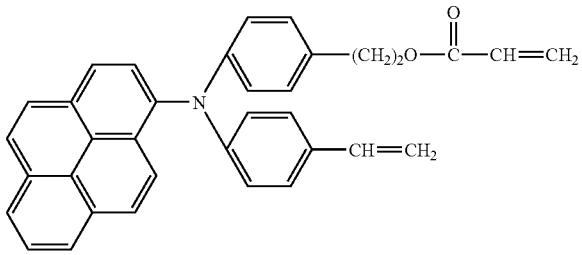 |
| 52 | 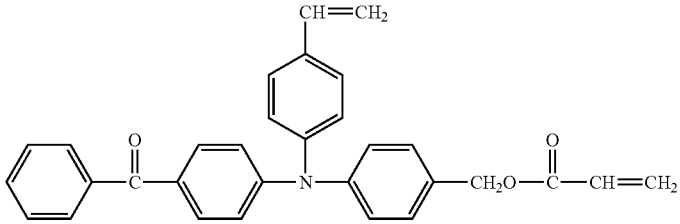 |
| 53 | 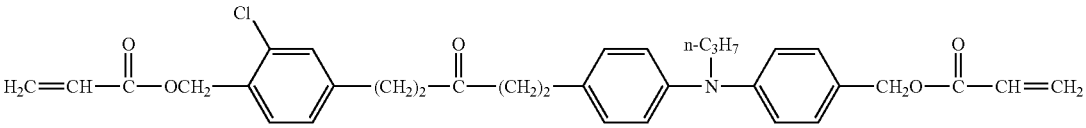 |
| 54 | 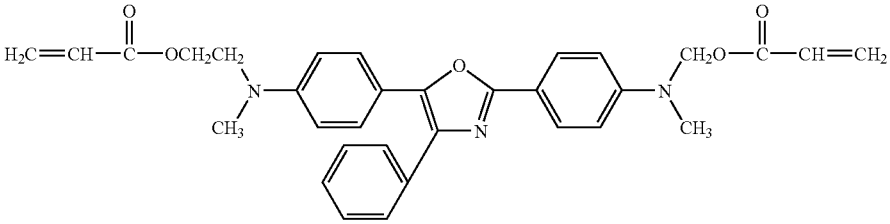 |
| 55 | 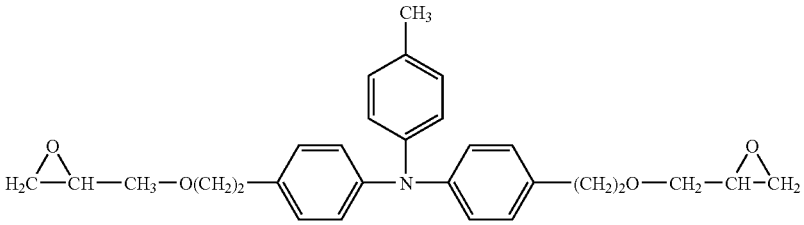 |
| 56 | 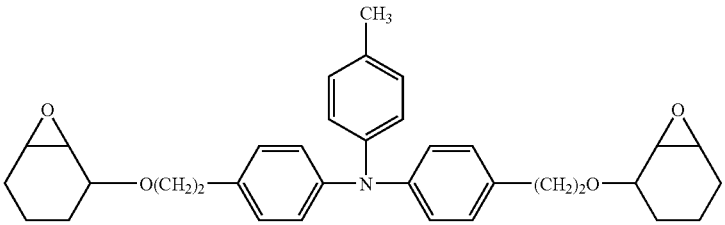 |
| 57 | 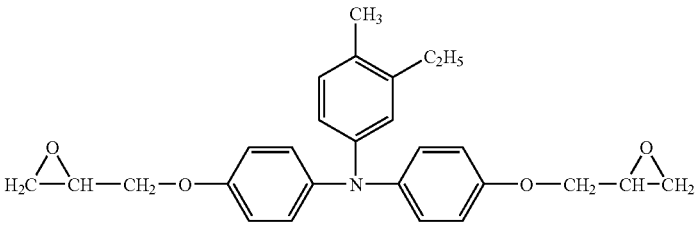 |

-continued
| No. | compound examples |
|---|---|
| 58 | 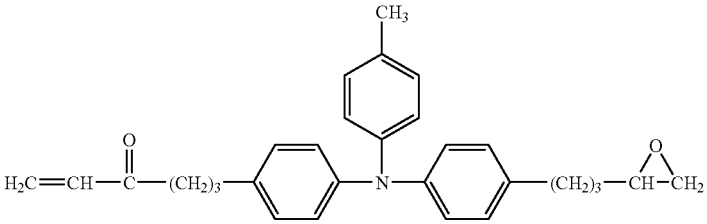 |
| 59 | 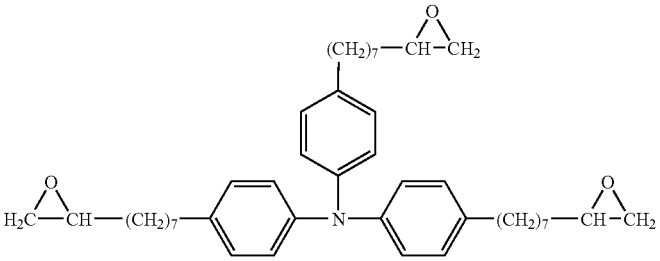 |
| 60 | 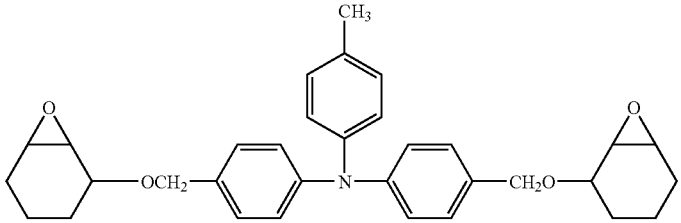 |
| 61 | 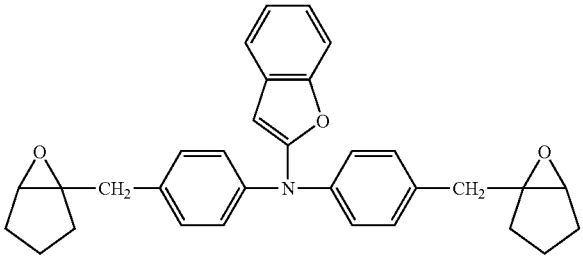 |
| 62 | 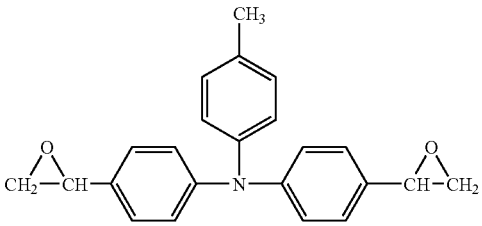 |
| 63 | 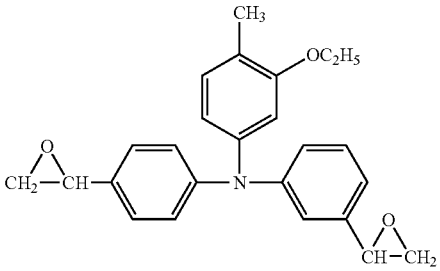 |

-continued
| No. | compound examples |
|---|---|
| 64 | 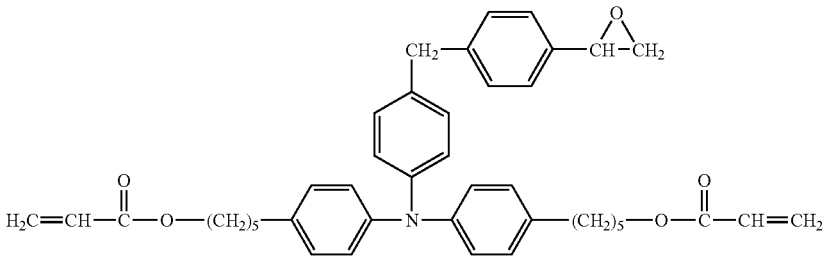 |
| 65 | 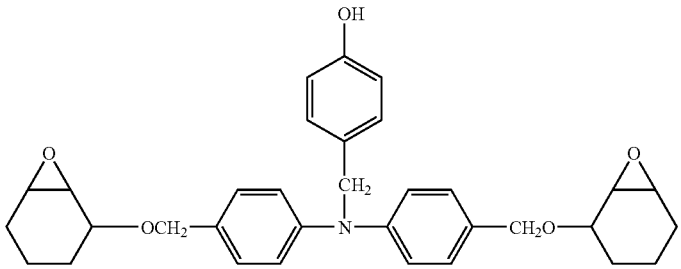 |
| 66 | 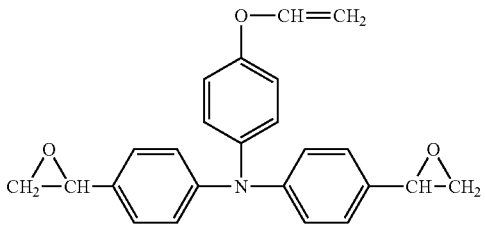 |
| 67 | 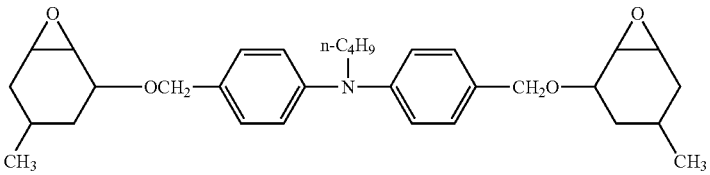 |
| 68 | 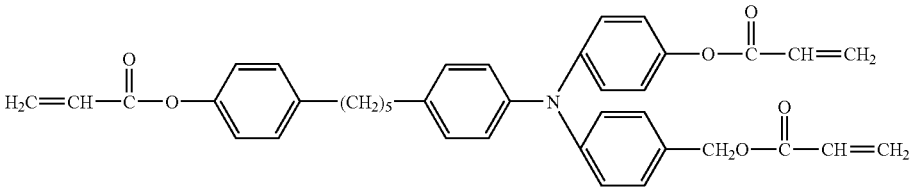 |
| 69 | 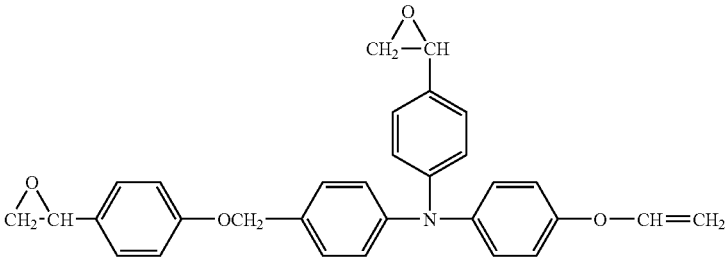 |

-continued
| No. | compound examples |
|---|---|
| 70 | 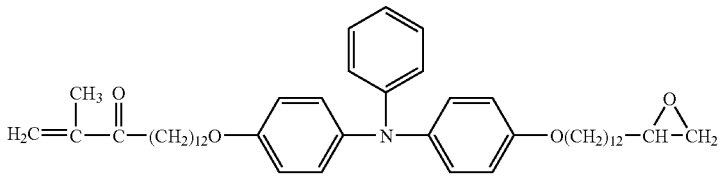 |
| 71 | 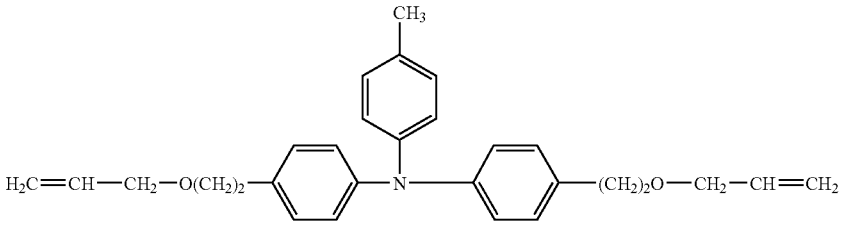 |
| 72 | 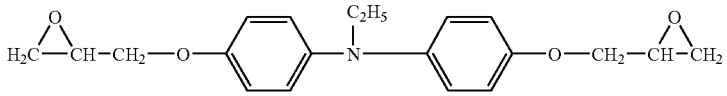 |
| 73 | 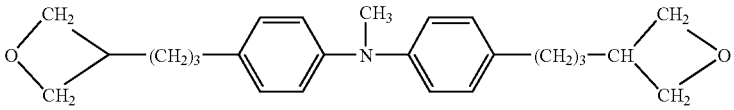 |
| 74 | 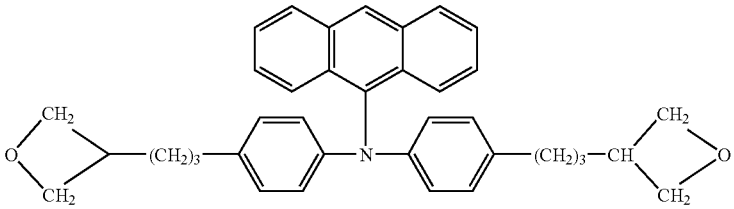 |
| 75 | 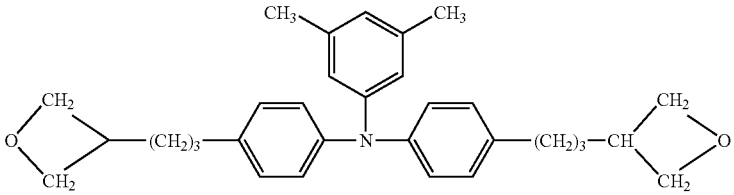 |
| 76 | 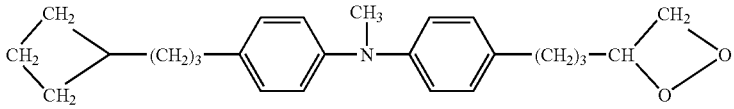 |
| 77 | 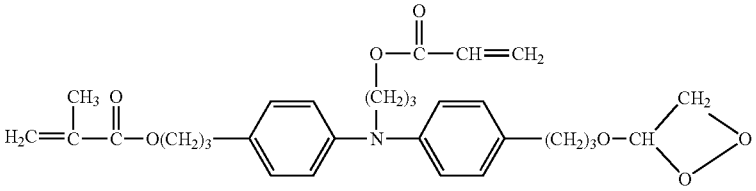 |
| 78 | 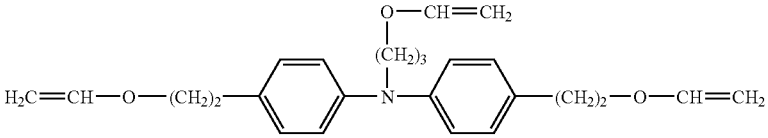 |

-continued
| No. | compound examples |
|---|---|
| 79 | 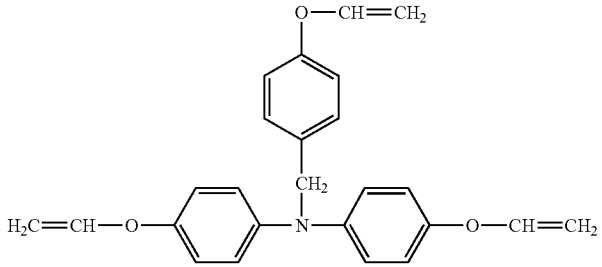 |
| 80 | 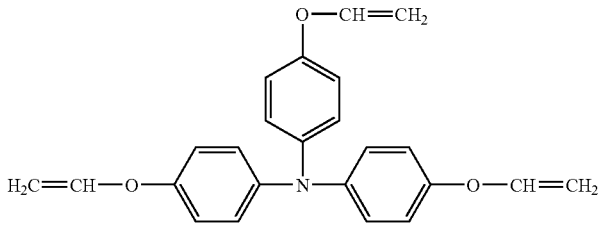 |
| 81 | 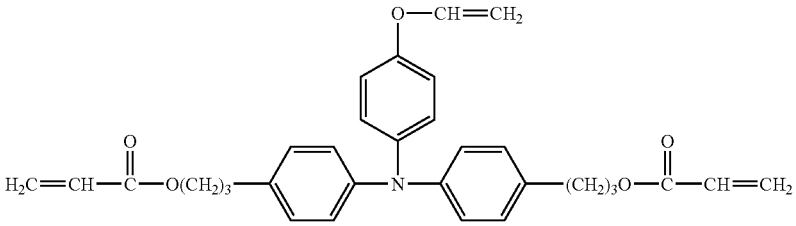 |
| 82 | 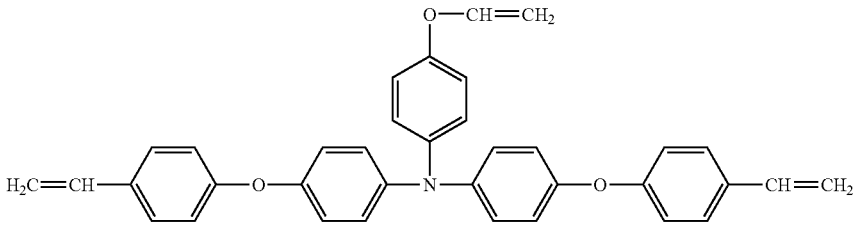 |
| 83 | 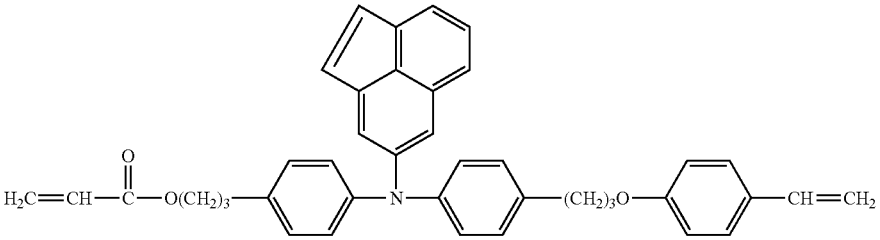 |
| 84 | 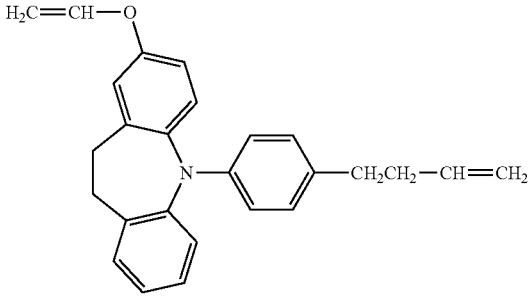 |

-continued
| No. | compound examples |
|---|---|
| 85 | 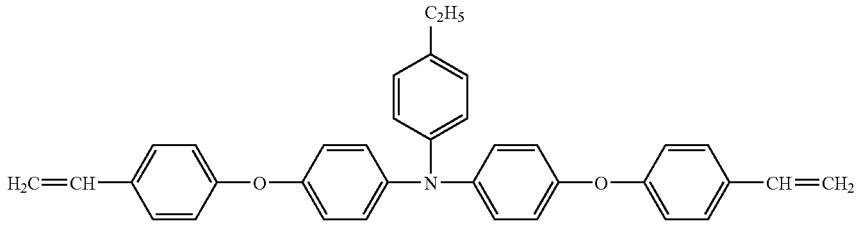 |
| 86 | 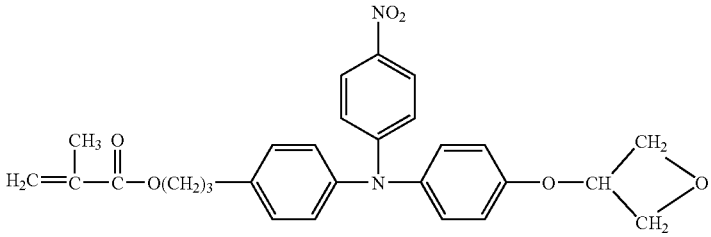 |
| 87 | 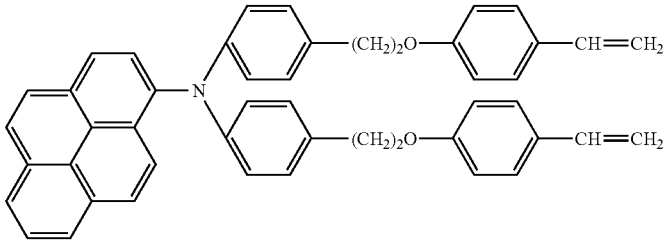 |
| 88 | 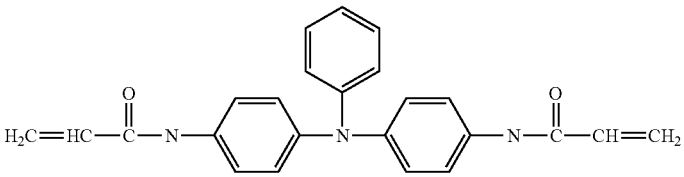 |
| 89 | 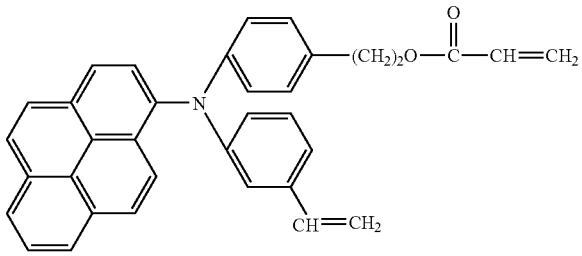 |
| 90 | 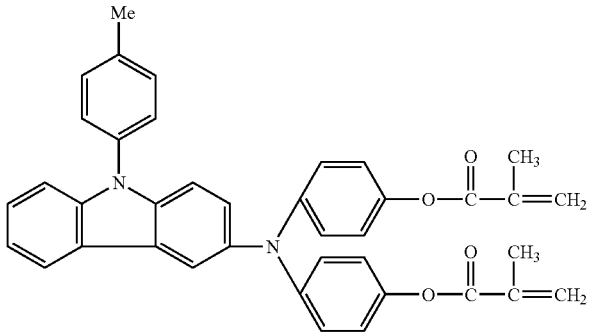 |

-continued
| No. | compound examples |
|---|---|
| 91 | 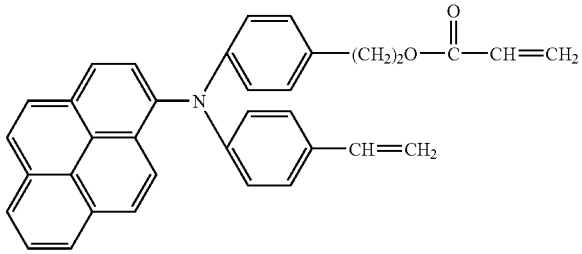 |
| 92 | 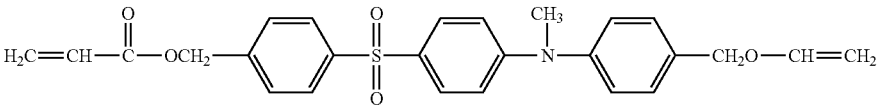 |
| 93 | 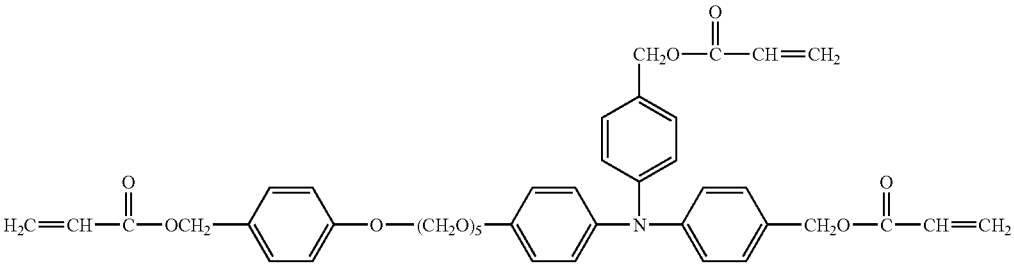 |
| 94 | 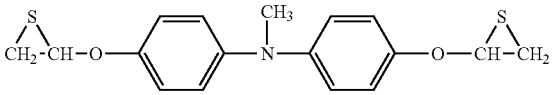 |
| 95 | 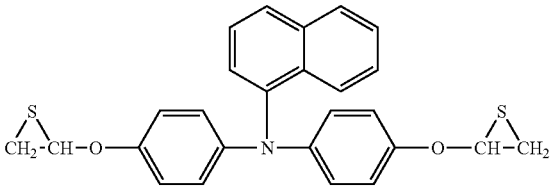 |
| 96 | 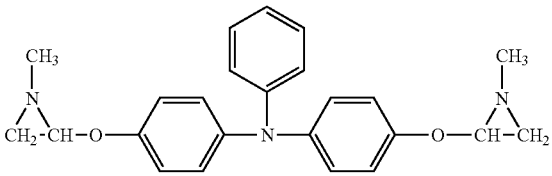 |
| 97 | 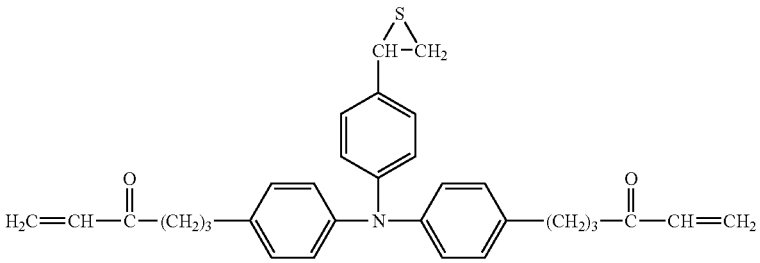 |

-continued
| No. | compound examples |
|---|---|
| 98 | 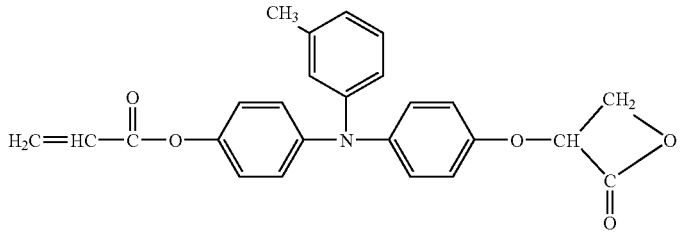 |
| 99 | 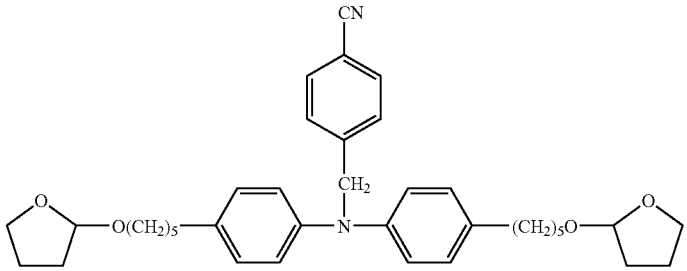 |
| 100 | 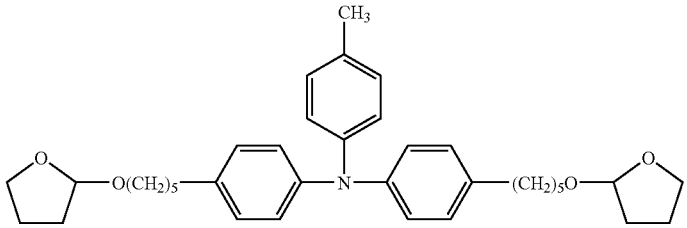 |
| 101 | 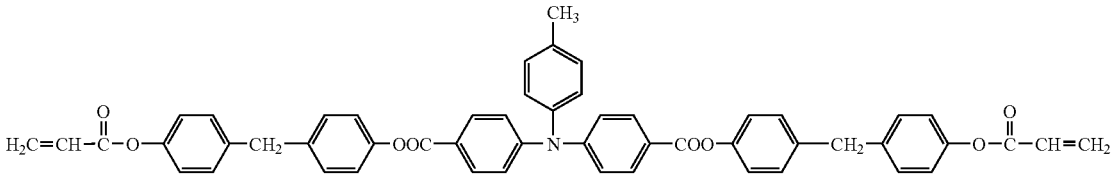 |
| 102 | 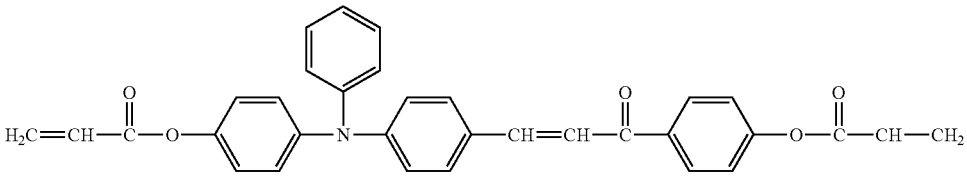 |
| 103 | 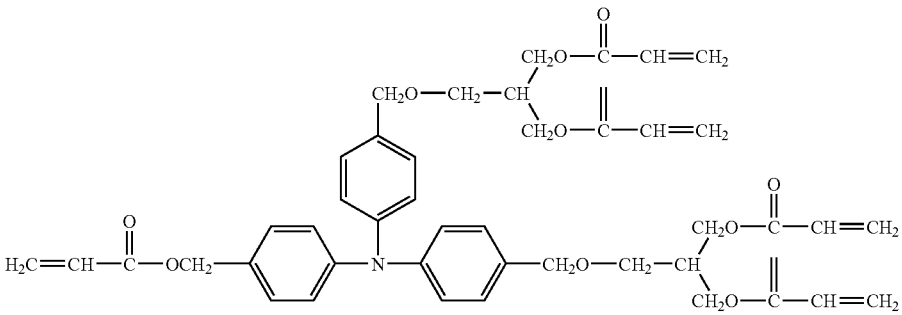 |

-continued
| No. | compound examples |
|---|---|
| 104 | 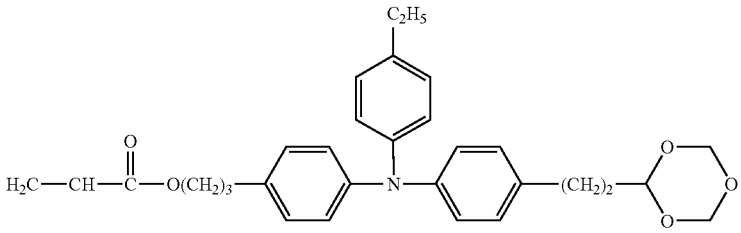 |
| 105 | 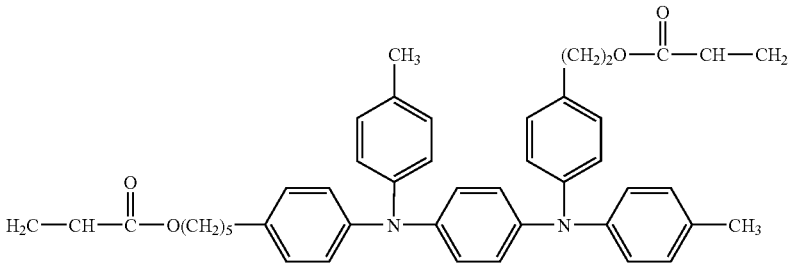 |
| 106 | 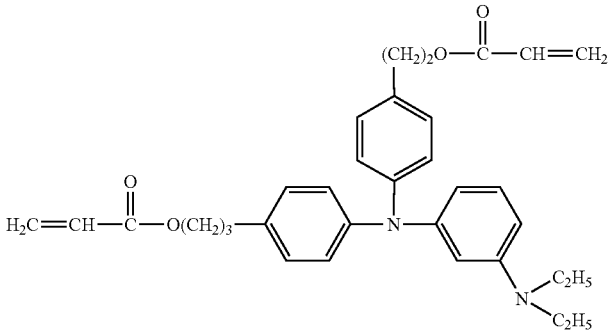 |
| 107 | 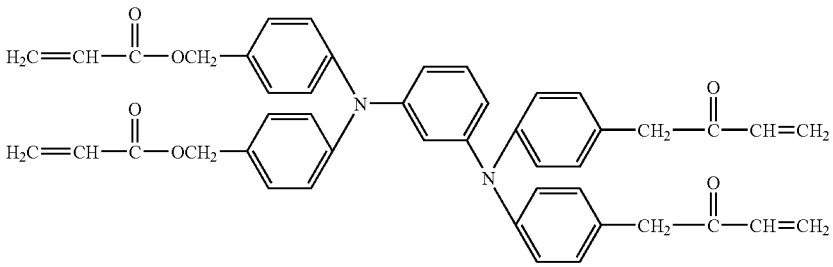 |
| 108 | 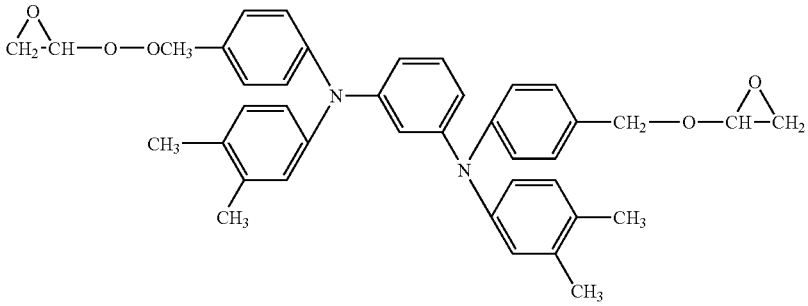 |

-continued
| No. | compound examples |
|---|---|
| 109 | 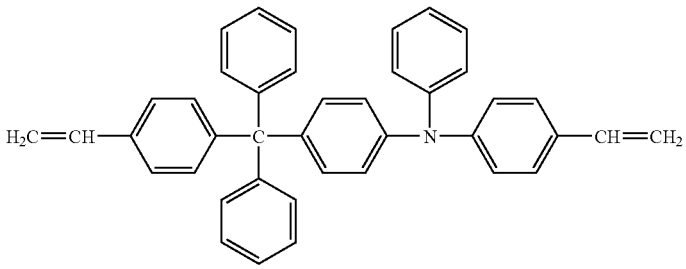 |
| 110 | 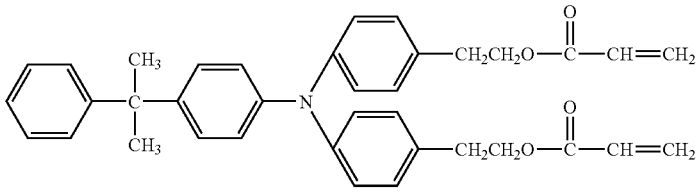 |
| 111 | 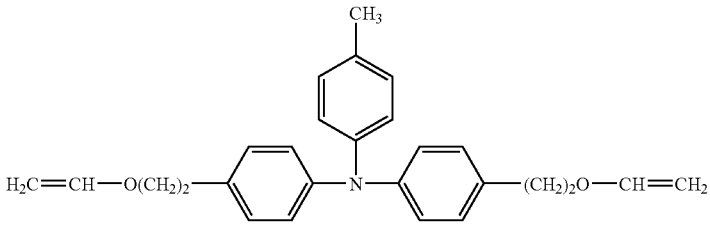 |
| 112 | 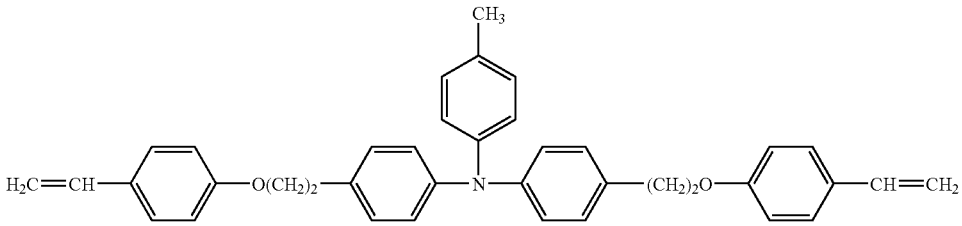 |
| 113 | 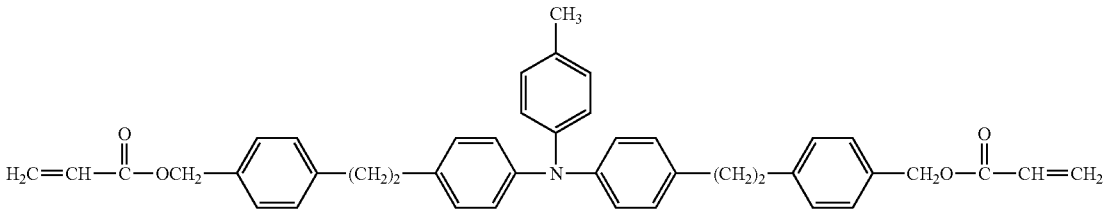 |
| 114 | 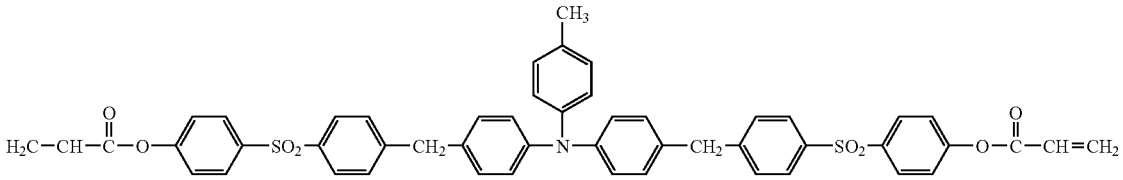 |
| 115 | 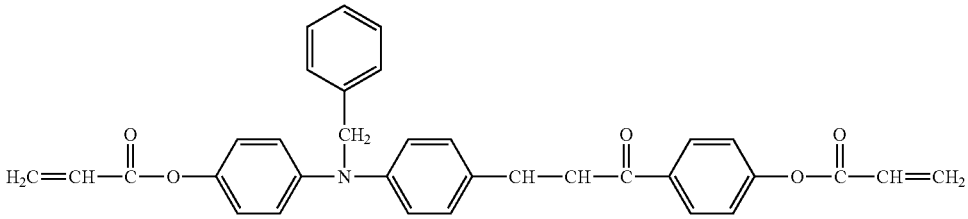 |

-continued

| No. | compound examples |
|---|---|
| 116 | 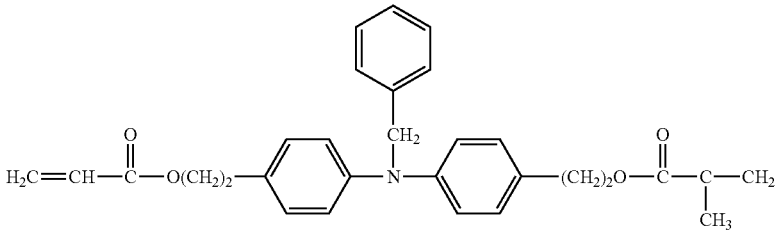 |
| 117 | 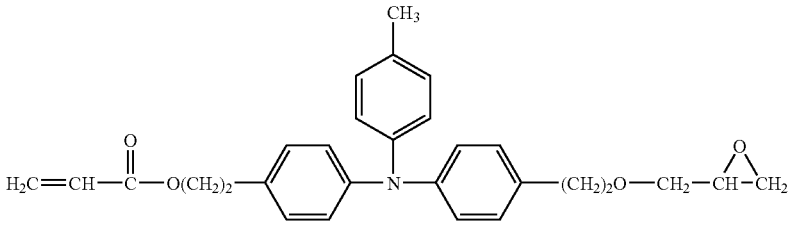 |
| 118 | 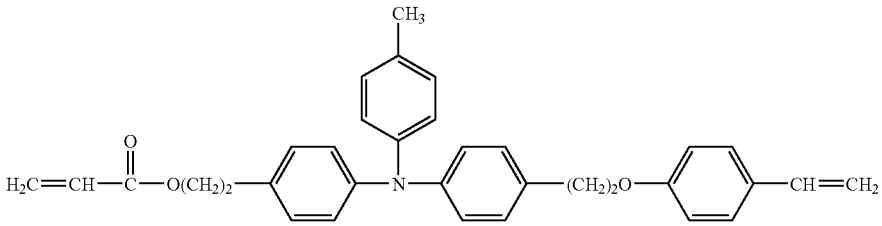 |
| 119 | 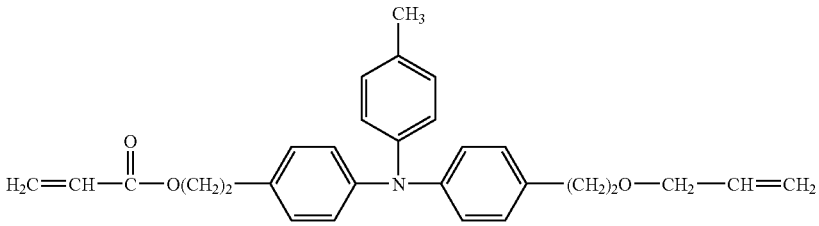 |

Next, the electrophotographic photosensitive member of the present invention will be described in more detail. The following description also relates to layers except the surface layer.

As described above, the electrophotographic photosensitive member of the present invention is an electrophotographic photosensitive member having a photosensitive layer on a support.

The photosensitive layer may be a monolayer type photosensitive layer containing a charge transporting substance and a charge generating substance in the same layer. Alternatively, the photosensitive layer may be a laminated type (function separating type) photosensitive layer separated into a charge generating layer containing a charge generating substance and a charge transporting layer containing a charge transporting substance. However, the photosensitive layer is preferably a laminated type photosensitive layer from the viewpoint of electrophotographic properties. In addition, laminated type photosensitive layers can be classified into a forward layer type photosensitive layer and a reverse layer type photosensitive layer. In a forward layer type photosensitive layer, a charge generating layer and a charge transporting layer are laminated on a support in this order. In a reverse layer type photosensitive layer, a charge transporting layer and a charge generating layer are laminated on a support in this order. However, the photosensitive layer is preferably a forward layer type photosensitive layer from the viewpoint of electrophotographic properties. A charge generating layer may adopt a laminated structure. Alternatively, a charge transporting layer may adopt a laminated structure.

Figure 3:
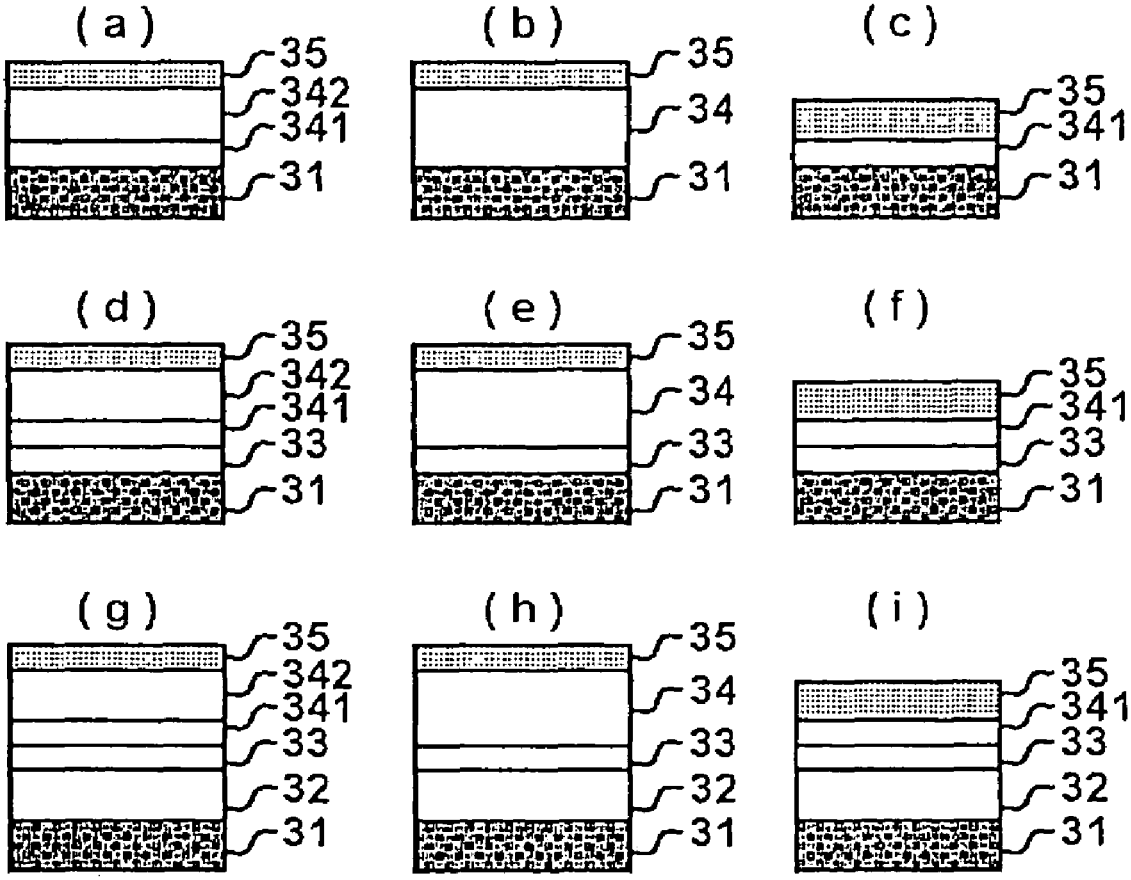
FIGS. 3(*a*) to 3(*i*) are diagrams each showing an example of a layer construction of an electrophotographic photosensitive member of the present invention.

FIGS. 3(*a*) to 3(*i*) each show an example of a layer construction of the electrophotographic photosensitive member of the present invention.

In the electrophotographic photosensitive member having the layer construction shown in FIG. 3(*a*), a layer (charge generating layer) 341 containing a charge generating substance and a layer (first charge transporting layer) 342 containing a charge transporting substance are arranged on a support 31 in this order. A layer 35 (second charge transporting layer) formed by polymerizing a hole-transporting compound having a chain polymerizable functional group is additionally arranged as the surface layer on the layer 342.

In the electrophotographic photosensitive member having the layer construction shown in FIG. 3(*b*), a layer 34 containing a charge generating substance and a charge transporting substance is arranged on the support 31. The layer 35 formed by polymerizing a hole-transporting compound having a chain polymerizable functional group is additionally arranged as the surface layer on the layer 34.

In the electrophotographic photosensitive member having the layer construction shown in FIG. 3(*c*), the layer (charge generating layer) 341 containing a charge generating substance is arranged on the support 31. Further, the layer 35 formed by polymerizing a hole-transporting compound having a chain polymerizable functional group is directly arranged as the surface layer on the layer 341.

As shown in each of FIGS. 3(*d*) to 3(*i*), an intermediate layer (also referred to as "base coating layer") 33 having a barrier function or an adhesion function or a conductive layer 32 intended for prevention of an interference fringe may be arranged between the support 31 and the layer (charge generating layer) 341 containing a charge generating substance or the layer 34 containing a charge generating substance and a charge transporting substance.

Any other layer constructions can be adopted as long as the universal hardness (HU) and elastic deformation ratio of the electrophotographic photosensitive member surface are in the above ranges. In the case where the surface layer of the electrophotographic photosensitive member is a layer formed by polymerizing a hole-transporting compound having a chain polymerizable functional group, the layer constructions shown in FIGS. 3(*a*), 3(*d*), and 3(*g*) are preferable out of the layer constructions shown in FIGS. 3(*a*) to 3(*i*).

The support is not limited as long as it is a support exhibiting conductivity (conductive support) and does not affect measurement of the hardness of the electrophotographic photosensitive member surface. For instance, a support made of a metal (alloy) such as aluminum, copper, chromium, nickel, zinc, or stainless steel can be used. The above-mentioned metal support or a plastic support having a layer coated with aluminum, an aluminum alloy, an indium oxide-tin oxide alloy, or the like through vacuum deposition can also be used. A support obtained by impregnating a conductive particle such as carbon black, a tin oxide particle, a titanium oxide particle, or a silver particle into plastics or paper together with an appropriate binder resin, a plastic support having a conductive binder resin, and other supports can also be used. The support may be of a cylindrical shape, a belt shape, or the like. However, the support is preferably of a cylindrical shape.

In addition, the surface of the support may be subjected to cutting processing, surface roughening processing, alumite processing, or the like for preventing an interference fringe caused by the scattering of laser light or the like.

As described above, a conductive layer intended for prevention of an interference fringe caused by the scattering of laser light or the like or for covering a flaw on the support may be arranged between the support and a photosensitive layer (consisting of a charge generating layer and a charge transporting layer) or an intermediate layer described below.

The conductive layer can be formed by dispersing a conductive particle such as carbon black, a metal particle, or a metal oxide particle into a binder resin.

The conductive layer has a thickness preferably in the range of 1 to 40 μm, particularly preferably in the range of 2 to 20 μm.

As described above, an intermediate layer having a barrier function or an adhesion function may also be arranged between the support or the conductive layer and the photosensitive layer (consisting of the charge generating layer and the charge transporting layer). The intermediate layer is formed for the purposes including: an improvement in adhesion of the photosensitive layer; an improvement in coating property; an improvement in property of injecting charge from the support; and protection of the photosensitive layer against an electrical breakdown.

The intermediate layer can be formed by using a material such as polyvinyl alcohol, poly-N-vinylimidazole, polyethylene oxide, ethylcellulose, an ethylene-acrylic acid copolymer, casein, polyamide, N-methoxymethylated nylon 6, copolymer nylon, glue, or gelatin.

The intermediate layer has a thickness preferably in the range of 0.1 to 2 μm.

Examples of the charge generating substance used in the electrophotographic photosensitive member of the present invention include: selenium-tellurium-based, pyrylium-based, and thiapyrylium-based dyes; phthalocyanine pigments having various central metals and various crystal systems (such as α, β, γ, ϵ, and X types); anthanthrone pigments; dibenzpyrenequinone pigments; pyranthrone pigments; azo pigments such as a monoazo pigment, a disazo pigment, and a trisazo pigment; indigo pigments; quinacridone pigments; asymmetric quinocyanine pigments; quinocyanine pigments; and amorphous silicon (described in JP 54-143645 A or the like). Each of those charge generating substances may be used alone, or 2 or more of them may be used in combination.

Examples of the charge transporting substance used in the electrophotographic photosensitive member of the present invention except the hole-transporting compound having a chain polymerizable functional group described above include: polymer compounds each having a heterocyclic ring or a condensed polycyclic aromatic compound such as poly-N-vinylcarbazole and polystyrylanthracene; heterocyclic compounds such as pyrazoline, imidazole, oxazole, triazole, and carbazole; triarylalkane derivatives such as triphenylmethane; triarylamine derivatives such as triphenylamine; phenylenediamine derivatives; N-phenylcarbazole derivatives; stilbene derivatives; and hydrazone derivatives.

In the case where the photosensitive layer consists of the charge generating layer and the charge transporting layer to separate functions, the charge generating layer can be formed by coating and drying a coating liquid for a charge generating layer prepared by dispersing a charge generating substance together with a binder resin and a solvent. The substance can be dispersed by using, for example, a homogenizer, an ultrasonic disperser, a ball mill, a vibrating ball mill, a sand mill, a roll mill, an attritor, or a liquid collision-type high-speed disperser. A ratio of the charge generating substance to the binder resin is preferably in the range of 1:0.3 to 1:4 (mass ratio). The charge generating substance can be singly formed into a film by means of a deposition method or the like to serve as the charge generating layer.

The charge generating layer has a thickness of preferably 5 μm or less, particularly preferably 0.1 to 2 μm.

In the case where the photosensitive layer consists of the charge generating layer and the charge transporting layer to separate functions, the charge transporting layer, in particular the charge transporting layer which is not the surface layer of the electrophotographic photosensitive member, can be formed by coating and drying a coating liquid for a charge transporting layer prepared by dissolving a charge transporting substance and a binder resin in a solvent. Of the charge transporting substances, a charge transporting substance having filming property by itself can be singly formed into a film with no binder resin to serve as the charge transporting layer. A ratio of the charge transporting substance to the binder resin is preferably in the range of 2:8 to 10:0 (mass ratio), particularly preferably in the range of 3:7 to 10:0 (mass ratio). An excessively small amount of charge transporting substance may reduce the charge transporting ability, thereby leading to a reduction in sensitivity and an increase in rest potential.

The charge transporting layer, in particular the charge transporting layer which is not the surface layer of the electrophotographic photosensitive member, has a thickness of preferably 1 to 50 μm, more preferably 1 to 30 μm, further preferably 3 to 30 μm, still further preferably 3 to 20 μm.

In the case where a charge transporting substance and a charge generating substance are allowed to be present in the same layer, the layer can be formed by coating and drying a coating liquid for the layer prepared by dispersing the charge generating substance and the charge transporting substance together with a binder resin and a solvent.

Examples of the binder resin used in the photosensitive layer (consisting of the charge transporting layer and the charge generating layer) include: a polymer or copolymer of a vinyl compound such as styrene, vinyl acetate, vinyl chloride, acrylate, methacrylate, vinylidene fluoride, or trifluoroethylene; a polyvinyl alcohol resin; a polyvinyl acetal resin; a polyvinyl butyral resin; a polycarbonate resin; a polyallylate resin; a polyester resin; a polysulfone resin; a polyphenylene oxide resin; a polyurethane resin; a cellulose resin; a phenol resin; a melamine resin; a silicon resin; and an epoxy resin. Each of those resins may be used alone, or 2 or more of them may be used as a mixture or a copolymer.

Figure 4:
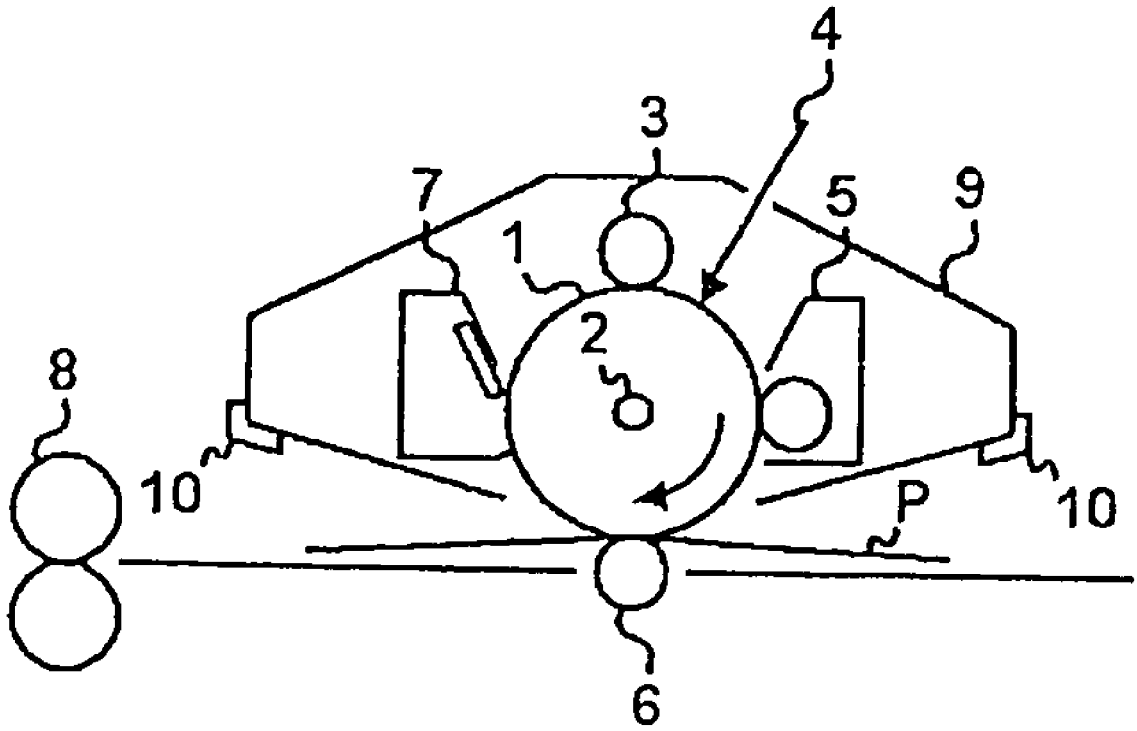
FIG. 4 is a diagram showing an example of a schematic construction of an electrophotographic apparatus equipped with a process cartridge having an electrophotographic photosensitive member of the present invention.

FIG. 4 shows an example of a schematic construction of an electrophotographic apparatus equipped with a process cartridge having the electrophotographic photosensitive member of the present invention.

In FIG. 4, a cylindrical electrophotographic photosensitive member 1 is driven to be rotated at a predetermined circumferential speed around a shaft 2 in the direction of an arrow.

The surface of the electrophotographic photosensitive member 1 which is driven to be rotated is uniformly charged to a positive or negative predetermined potential by charging means (primary charging means such as a charging roller) 3. Then, the surface receives exposure light (image exposure light) 4 output from exposure means (not shown) such as slit exposure or laser beam scanning exposure. Thus, an electrostatic latent image corresponding to a target image is sequentially formed on the surface of the electrophotographic photosensitive member 1.

The electrostatic latent image formed on the surface of the electrophotographic photosensitive member 1 is developed with toner in a developer of developing means 5 to provide a toner image. Then, a transfer bias from transferring means (such as a transferring roller) 6 sequentially transfers the toner image formed and supported on the surface of the electrophotographic photosensitive member 1 onto transfer material (such as paper) P taken out and fed from transfer material feeding means (not shown) to a position (abutting portion) between the electrophotographic photosensitive member 1 and the transferring means 6 in synchronization with the rotation of the electrophotographic photosensitive member 1.

The transfer material P onto which the toner image has been transferred is separated from the surface of the electrophotographic photosensitive member 1 and is introduced into fixing means 8 to receive image fixation. As a result, the transfer material P is printed out as an image-formed object (print or copy) to the outside of the apparatus.

Cleaning means (such as a cleaning blade) 7 cleans the surface of the electrophotographic photosensitive member 1 after the transfer of the toner image by removing a residual developer (toner) from the surface. Furthermore, the surface of the electrophotographic photosensitive member 1 is subjected to charge eliminating treatment with preexposure light (not shown) from preexposure means (not shown) to be repeatedly used for image formation. Preexposure is not always necessary in the case where the charging means 3 is contact charging means using a charging roller as shown in FIG. 4.

The following procedure may also be employed. That is, multiple of the components such as the electrophotographic photosensitive member 1, the charging means 3, the developing means 5, the transferring means 6, and the cleaning means 7 are stored in a vessel and integrally connected to one another to construct a process cartridge that is detachable from the main body of an electrophotographic apparatus such as a copying machine or a laser beam printer. In FIG. 4, the electrophotographic photosensitive member 1, the charging means 3, the developing means 5, and the cleaning means 7 are integrally supported to construct a process cartridge 9 that is detachable from the main body of the electrophotographic apparatus by means of guide means 10 such as a rail of the main body of the electrophotographic apparatus.

EXAMPLES

Hereinafter, the present invention will be described in more detail by way of specific examples. However, the present invention is not limited to these examples. The term "part" in each example means "part by mass".

Example 1

An aluminum cylinder of 30 mm in diameter and 357.5 mm in length the surface of which had been subjected to honing treatment and ultrasonic cleaning was provided as a support.

Then, 5 parts of N-methoxymethylated nylon 6 were dissolved in 95 parts of methanol to prepare a coating liquid for an intermediate layer.

The coating liquid for an intermediate layer was dip-coated on the support and dried at 100° C. for 20 minutes to form an intermediate layer of 0.6 μm in thickness.

Next, 3 parts of oxytitaniumphthalocyanine crystal (charge generating substance) having strong peaks at Bragg angles 2θ±0.2° in CuKα characteristic X-ray diffraction of 9.0°, 14.2°, 23.9°, and 27.1°, 3 parts of a polyvinyl butyral resin (trade name: S-LEC BM2, available from Sekisui Chemical Co., Ltd.), and 35 parts of cyclohexanone were dispersed for 2 hours by means of a sand mill apparatus using a glass bead of 1 mm in diameter. Then, 60 parts of ethyl acetate were added to the dispersed product to prepare a coating liquid for a charge generating layer.

The coating liquid for a charge generating layer was dip-coated on the intermediate layer and dried at 50° C. for 10 minutes to form a charge generating layer of 0.2 μm in thickness.

Next, 60 parts of a hole-transporting compound having a structure represented by the following formula (E-1) were dissolved in a mixed solvent of 30 parts of monochlorobenzene and 30 parts of dichloromethane to prepare a coating liquid for a charge transporting layer.

(E-1)

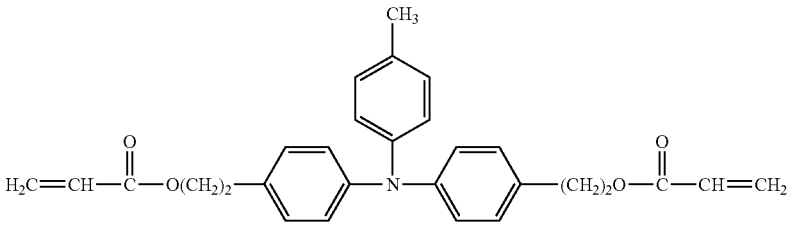

The coating liquid for a charge transporting layer was dip-coated on the charge generating layer.

Next, the coating liquid for a charge transporting layer coated on the charge generating layer was irradiated with an electron beam in an atmosphere with an oxygen concentration of 10 ppm at an accelerating voltage of 150 kV and an irradiation dose of 4 Mrad. After that, heat treatment was performed for 10 minutes in the same atmosphere under a condition for allowing the temperature of an electrophotographic photosensitive member (=the irradiated body for the electron beam) to reach 100° C. to thereby form a charge transporting layer of 15 μm in thickness.

In this way, an electrophotographic photosensitive member for measurement of surface properties (for measurement of a universal hardness (HU) and an elastic deformation ratio) of Example 1 was prepared.

In addition, another electrophotographic photosensitive member was prepared in exactly the same manner as described above and used as an electrophotographic photosensitive member for an actual machine test of Example 1.

<Measurement of Universal Hardness (HU) and Elastic Deformation Ratio>

The electrophotographic photosensitive member for measurement of surface properties was left in a 25° C./50% RH environment for 24 hours. After that, the universal hardness (HU) and elastic deformation ratio of the photosensitive member were measured by using the above-mentioned FISCHERSCOPE H100V manufactured by. Fischer in the manner as described above. Table 1 shows the measurements of the universal hardness (HU) and the elastic deformation ratio.

<Actual Machine Test>

The electrophotographic photosensitive member for an actual machine test was fitted into a copying machine GP40 manufactured by Canon in a normal-temperature and normal-humidity (23° C./50% RH) environment to evaluate an initial output image. Subsequently, a 40,000-sheet feeding endurance test was performed to evaluate an output image and to measure an abrasion amount of the electrophotographic photosensitive member after the endurance test. An eddy current-type thicknessmeter PERMASCOPE TYPE E111 (manufactured by Fischer) was used for measuring the abrasion amount. The endurance test was performed in an intermittent mode in which the machine was stopped every time one sheet was printed. Table 1 shows the evaluation results of the actual machine test.

TABLE 1

| | | Elastic | Initial stage | After 40,000-sheet feeding endurance test | |
|---|---|---|---|---|---|
| | HU [N/mm$^2$] | deformation ratio [%] | Image evaluation | Image evaulation | Abrasion [μm] |
| Example 1 | 190 | 52 | Good | Good | 0.6 |
| Example 2 | 193 | 53 | Good | Good | 0.5 |
| Example 3 | 195 | 55 | Good | Good | 0.5 |
| Example 4 | 176 | 53 | Good | Good | 0.6 |
| Example 5 | 180 | 55 | Good | Good | 0.8 |
| Example 6 | 183 | 56 | Good | Good | 0.6 |
| Example 7 | 206 | 53 | Good | Good However, a small number of flaws with a size of about 2 μm, which do not appear on an image, were generated. | 0.4 |
| Example 8 | 208 | 57 | Good | Good However, a small number of flaws with a size of about 2 μm, which do not appear on an image, were generated. | 0.3 |

TABLE 1-continued

| | HU [N/mm$^2$] | Elastic deformation ratio [%] | Initial stage Image evaluation | After 40,000-sheet feeding endurance test Image evaulation | Abrasion [μm] |
|---|---|---|---|---|---|
| Example 9 | 215 | 60 | Good | Good However, a small number of flaws with a size of about 2 μm, which do not appear on an image, were generated. | 0.3 |
| Example 10 | 210 | 52 | Good | Good However, a large number of flaws with a size of about 2 μm, which do not appear on an image, were generated. | 0.6 |
| Example 11 | 215 | 51 | Good | Good However, a large number of flaws with a size of about 2 μm, which do not appear on an image, were generated. | 1.0 |
| Example 12 | 207 | 55 | Good | Good However, a small number of flaws with a size of about 1.5 μm, which do not appear on an image, were generated. | 0.8 |
| Example 13 | 210 | 52 | Good | Good However, a small number of flaws with a size of about 2 μm, which do not appear on an image, were generated. | 0.6 |
| Example 14 | 174 | 51 | Good | Good | 0.6 |

Example 2

An electrophotographic photosensitive member for measurement of surface properties and an electrophotographic photosensitive member for an actual machine test were prepared in the same manner as in Example 1 except that the irradiation dose in Example 1 in irradiating the coating liquid for a charge transporting layer with an electron beam was changed from 4 Mrad to 8 Mrad. In addition, measurement of the universal hardness (HU) and the elastic deformation ratio, and an actual machine test were performed in the same manner as in Example 1. Table 1 shows the measurements of the universal hardness (HU) and the elastic deformation ratio, and the evaluation results of the actual machine test.

Example 3

An electrophotographic photosensitive member for measurement of surface properties and an electrophotographic photosensitive member for an actual machine test were prepared in the same manner as in Example 1 except that the irradiation dose in Example 1 in irradiating the coating liquid for a charge transporting layer with an electron beam was changed from 4 Mrad to 20 Mrad. In addition, measurement of the universal hardness (HU) and the elastic deformation ratio, and an actual machine test were performed in the same manner as in Example 1. Table 1 shows the measurements of the universal hardness (HU) and the elastic deformation ratio, and the evaluation results of the actual machine test.

Example 4

An intermediate layer and a charge generating layer were formed on a support in the same manner as in Example 1.

Next, 10 parts of a styryl compound having a structure represented by the following formula (E-2) and 10 parts of a polycarbonate resin (having a viscosity average molecular weight (Mv) of 20,000) having a repeating structural unit represented by the following formula (E-3) were dissolved in a mixed solvent of 50 parts of monochlorobenzene and 30 parts of dichloromethane to prepare a coating liquid for a first charge transporting layer.

(E-2)

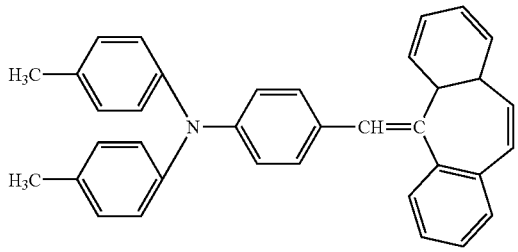

(E-3)

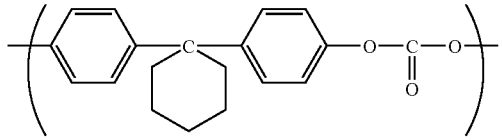

The coating liquid for a first charge transporting layer was dip-coated on the charge generating layer and dried at 120° C. for 1 hour to form a first charge transporting layer of 20 μm in thickness.

Next, 60 parts of the hole-transporting compound having the structure represented by the above formula (E-1) were dissolved in a mixed solvent of 50 parts of monochlorobenzene and 50 parts of dichloromethane to prepare a coating liquid for a second charge transporting layer.

The coating liquid for a second charge transporting layer was spray-coated on the first charge transporting layer.

Next, the coating liquid for a second charge transporting layer coated on the first charge transporting layer was irradiated with an electron beam in an atmosphere with an oxygen concentration of 10 ppm at an accelerating voltage of 150 kV and an irradiation dose of 4 Mrad. After that, heat treatment was performed for 10 minutes in the same atmosphere under a condition for allowing the temperature of an electrophotographic photosensitive member (=the irradiated body for the electron beam) to reach 100° C. to thereby form a second charge transporting layer of 5 μm in thickness.

In this way, an electrophotographic photosensitive member for measurement of surface properties of Example 4 was prepared.

In addition, another electrophotographic photosensitive member was prepared in exactly the same manner as described above and used as an electrophotographic photosensitive member for an actual machine test of Example 4.

The universal hardness (HU) and elastic deformation ratio of the electrophotographic photosensitive member for measurement of surface properties of Example 4 were measured in the same manner as in Example 1. In addition, an actual machine test was performed on the electrophotographic photosensitive member for an actual machine test of Example 4 in the same manner as in Example 1. Table 1 shows the measurements of the universal hardness (HU) and the elastic deformation ratio, and the evaluation results of the actual machine test.

Example 5

An electrophotographic photosensitive member for measurement of surface properties and an electrophotographic photosensitive member for an actual machine test were prepared in the same manner as in Example 4 except that the irradiation dose in Example 4 in irradiating the coating liquid for a second charge transporting layer with an electron beam was changed from 4 Mrad to 8 Mrad. In addition, measurement of the universal hardness (HU) and the elastic deformation ratio, and an actual machine test were performed in the same manner as in Example 4. Table 1 shows the measurements of the universal hardness (HU) and the elastic deformation ratio, and the evaluation results of the actual machine test.

Example 6

An electrophotographic photosensitive member for measurement of surface properties and an electrophotographic photosensitive member for an actual machine test were prepared in the same manner as in Example 4 except that the irradiation dose in Example 4 in irradiating the coating liquid for a second charge transporting layer with an electron beam was changed from 4 Mrad to 20 Mrad. In addition, measurement of the universal hardness (HU) and the elastic deformation ratio, and an actual machine test were performed in the same manner as in Example 4. Table 1 shows the measurements of the universal hardness (HU) and the elastic deformation ratio, and the evaluation results of the actual machine test.

Example 7

An electrophotographic photosensitive member for measurement of surface properties and an electrophotographic photosensitive member for an actual machine test were prepared in the same manner as in Example 1 except that the hole-transporting compound used for the charge transporting layer in Example 1 was changed from the charge transportable compound having the structure represented by the above formula (E-1) to a charge transportable compound having a structure represented by the following formula (E-4). In addition, measurement of the universal hardness (HU) and the elastic deformation ratio, and an actual machine test were performed in the same manner as in Example 1. Table 1 shows the measurements of the universal hardness (HU) and the elastic deformation ratio, and the evaluation results of the actual machine test.

(E-4)

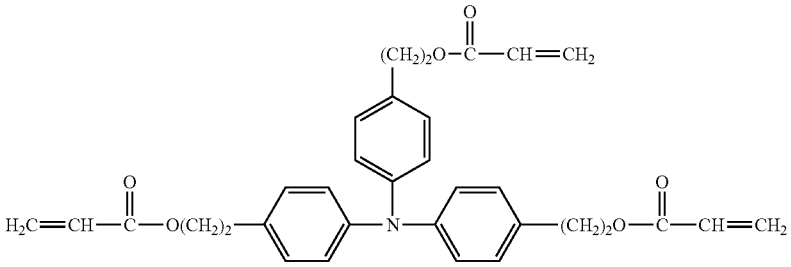

Example 8

An electrophotographic photosensitive member for measurement of surface properties and an electrophotographic photosensitive member for an actual machine test were prepared in the same manner as in Example 2 except that the hole-transporting compound used for the charge transporting layer in Example 2 was changed from the charge transportable compound having the structure represented by the above formula (E-1) to the charge transportable compound having the structure represented by the above formula (E-4). In addition, measurement of the universal hardness (HU) and the elastic deformation ratio, and an actual machine test were performed in the same manner as in Example 2. Table 1 shows the measurements of the universal hardness (HU) and the elastic deformation ratio, and the evaluation results of the actual machine test.

Example 9

An electrophotographic photosensitive member for measurement of surface properties and an electrophotographic photosensitive member for an actual machine test were prepared in the same manner as in Example 3 except that the hole-transporting compound used for the charge transporting layer in Example 3 was changed from the charge transportable compound having the structure represented by the above formula (E-1) to the charge transportable compound having the structure represented by the above formula (E-4). In addition, measurement of the universal hardness (HU) and the elastic deformation ratio, and an actual machine test were performed in the same manner as in Example 3. Table 1 shows the measurements of the universal hardness (HU) and the elastic deformation ratio, and the evaluation results of the actual machine test.

Example 10

An electrophotographic photosensitive member for measurement of surface properties and an electrophotographic photosensitive member for an actual machine test were prepared in the same manner as in Example 1 except that the hole-transporting compound used for the charge transporting layer in Example 1 was changed from the charge transportable compound having the structure represented by the above formula (E-1) to a charge transportable compound having a structure represented by the following formula (E-5). In addition, measurement of the universal hardness (HU) and the elastic deformation ratio, and an actual machine test were performed in the same manner as in Example 1. Table 1 shows the measurements of the universal hardness (HU) and the elastic deformation ratio, and the evaluation results of the actual machine test.

(E-5)

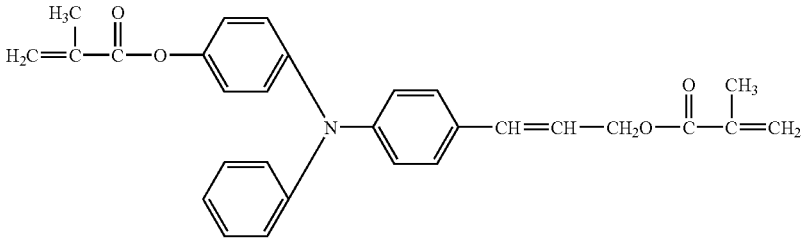

Example 11

An electrophotographic photosensitive member for measurement of surface properties and an electrophotographic photosensitive member for an actual machine test were prepared in the same manner as in Example 1 except that the hole-transporting compound used for the charge transporting layer in Example 1 was changed from the charge transportable compound having the structure represented by the above formula (E-1) to a charge transportable compound having a structure represented by the following formula (E-6). In addition, measurement of the universal hardness (HU) and the elastic deformation ratio, and an actual machine test were performed in the same manner as in Example 1. Table 1 shows the measurements of the universal hardness (HU) and the elastic deformation ratio, and the evaluation results of the actual machine test.

(E-6)

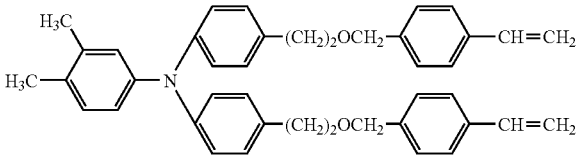

Example 12

An electrophotographic photosensitive member for measurement of surface properties and an electrophotographic photosensitive member for an actual machine test were prepared in the same manner as in Example 1 except that the hole-transporting compound used for the charge transporting layer in Example 1 was changed from the charge transportable compound having the structure represented by the above formula (E-1) to a charge transportable compound having a structure represented by the following formula (E-7). In addition, measurement of the universal hardness (HU) and the elastic deformation ratio, and an actual machine test were performed in the same manner as in Example 1. Table 1 shows the measurements of the universal hardness (HU) and the elastic deformation ratio, and the evaluation results of the actual machine test.

(E-7)

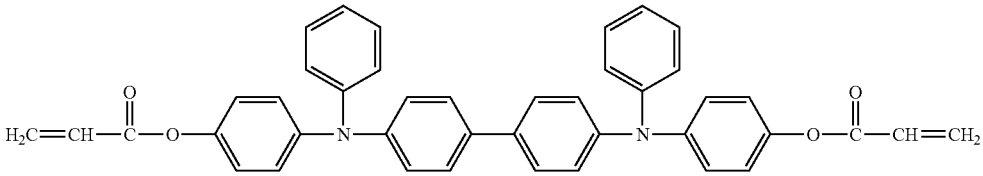

Example 13

An electrophotographic photosensitive member for measurement of surface properties and an electrophotographic photosensitive member for an actual machine test were prepared in the same manner as in Example 7 except that a coating liquid for a charge transporting layer prepared as described below was used instead of that of Example 7. In addition, measurement of the universal hardness (HU) and the elastic deformation ratio, and an actual machine test were performed in the same manner as in Example 7. Table 1 shows the measurements of the universal hardness (HU) and the elastic deformation ratio, and the evaluation results of the actual machine test.

That is, 40 parts of the hole-transporting compound having the structure represented by the above formula (E-4) and 20 parts of a hole-transporting compound having a structure represented by the following formula (E-8) were dissolved in a mixed solvent of 50 parts of monochlorobenzene and 50 parts of dichloromethane to prepare the coating liquid for a charge transporting layer of Example 13.

(E-8)

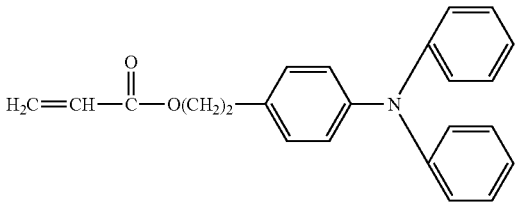

Example 14

An electrophotographic photosensitive member for measurement of surface properties and an electrophotographic photosensitive member for an actual machine test were prepared in the same manner as in Example 1 except that a coating liquid for a charge transporting layer prepared as described below was used instead of that of Example 1. In addition, measurement of the universal hardness (HU) and the elastic deformation ratio, and an actual machine test were performed in the same manner as in Example 1. Table 1 shows the measurements of the universal hardness (HU) and the elastic deformation ratio, and the evaluation results of the actual machine test.

That is, first, 5 parts of polytetrafluoroethylene resin particles (trade name: Leblanc L-2, available from Daikin Industries, Ltd.) and 50 parts of monochlorobenzene were dispersed by means of a sand mill apparatus using a glass bead. Then, 60 parts of the hole-transporting compound having the structure represented by the above formula (E-1) and 50 parts of dichloromethane were added to the dispersed product to dissolve the hole-transporting compound having the structure represented by the above formula (E-1). After that, 30 parts of dichloromethane were additionally added to the solution to prepare the coating liquid for a charge transporting layer of Example 14.

Example 15

An electrophotographic photosensitive member for measurement of surface properties and an electrophotographic photosensitive member for an actual machine test were prepared in the same manner as in Example 4 except that the "condition for allowing the temperature of an electrophotographic photosensitive member to reach 100° C." in Example 4 in performing heat treatment after the irradiation of the coating liquid for a second charge transporting layer with an electron beam was changed to a "condition for allowing the temperature of an electrophotographic photosensitive member to reach 70° C.". In addition, measurement of the universal hardness (HU) and the elastic deformation ratio, and an actual machine test were performed in the same manner as in Example 4. Table 2 shows the measurements of the universal hardness (HU) and the elastic deformation ratio, and the evaluation results of the actual machine test.

TABLE 2

| | HU [N/mm$^2$] | Elastic deformation ratio[%] | Initial stage Image evaluation | After 40,000-sheet feeding endurance test Image evaluation | After 40,000-sheet feeding endurance test Abrasion [μm] |
|---|---|---|---|---|---|
| Example 15 | 150 | 51 | Good | Good However, a small number of flaws with a size of about 2 μm, which do not appear on an image, were generated. | 1.1 |
| Example 16 | 160 | 52 | Good | Good | 0.9 |
| Example 17 | 200 | 54 | Good | Good | 0.5 |
| Example 18 | 220 | 55 | Good | Good However, a small number of flaws with a size of about 2 μm, which do not appear on an image, were generated. | 0.3 |
| Example 19 | 169 | 50 | Good | Good | 0.9 |
| Example 20 | 198 | 65 | Good | Good | 0.3 |
| Example 21 | 170 | 53 | Good | Good | 0.8 |
| Example 22 | 166 | 52 | Good | Good | 1.0 |

Example 16

An electrophotographic photosensitive member for measurement of surface properties and an electrophotographic photosensitive member for an actual machine test were prepared in the same manner as in Example 4 except that the "condition for allowing the temperature of an electrophotographic photosensitive member to reach 100° C." in Example 4 in performing heat treatment after the irradiation of the coating liquid for a second charge transporting layer with an electron beam was changed to a "condition for allowing the temperature of an electrophotographic photosensitive member to reach 80° C.". In addition, measurement of the universal hardness (HU) and the elastic deformation ratio, and an actual machine test were performed in the same manner as in Example 4. Table 2 shows the measurements of the universal hardness (HU) and the elastic deformation ratio, and the evaluation results of the actual machine test.

Example 17

An electrophotographic photosensitive member for measurement of surface properties and an electrophotographic photosensitive member for an actual machine test were prepared in the same manner as in Example 4 except that the "condition for allowing the temperature of an electrophotographic photosensitive member to reach 100° C." in Example 4 in performing heat treatment after the irradiation of the coating liquid for a second charge transporting layer with an electron beam was changed to a "condition for allowing the temperature of an electrophotographic photosensitive member to reach 110° C.". In addition, measurement of the universal hardness (HU) and the elastic deformation ratio, and an actual machine test were performed in the same manner as in Example 4. Table 2 shows the measurements of the universal hardness (HU) and the elastic deformation ratio, and the evaluation results of the actual machine test.

Example 18

An electrophotographic photosensitive member for measurement of surface properties and an electrophotographic photosensitive member for an actual machine test were prepared in the same manner as in Example 4 except that the "condition for allowing the temperature of an electrophotographic photosensitive member to reach 100° C." in Example 4 in performing heat treatment after the irradiation of the coating liquid for a second charge transporting layer with an electron beam was changed to a "condition for allowing the temperature of an electrophotographic photosensitive member to reach 120° C.". In addition, measurement of the universal hardness (HU) and the elastic deformation ratio, and an actual machine test were performed in the same manner as in Example 4. Table 2 shows the measurements of the universal hardness (HU) and the elastic deformation ratio, and the evaluation results of the actual machine test.

Example 19

An electrophotographic photosensitive member for measurement of surface properties and an electrophotographic photosensitive member for an actual machine test were prepared in the same manner as in Example 14 except that the amount of the polytetrafluoroethylene resin particles used in preparing a coating liquid for a charge transporting layer in Example 14 was changed from 5 parts to 10 parts. In addition, measurement of the universal hardness (HU) and the elastic deformation ratio, and an actual machine test were performed in the same manner as in Example 14. Table 2 shows the measurements of the universal hardness (HU) and the elastic deformation ratio, and the evaluation results of the actual machine test.

Example 20

An electrophotographic photosensitive member for measurement of surface properties and an electrophotographic photosensitive member for an actual machine test were prepared in the same manner as in Example 6 except that the "condition for allowing the temperature of an electrophotographic photosensitive member to reach 100° C." in Example 6 in performing heat treatment after the irradiation of the coating liquid for a second charge transporting layer with an electron beam was changed to a "condition for allowing the temperature of an electrophotographic photosensitive member to reach 140° C.". In addition, measurement of the universal hardness (HU) and the elastic deformation ratio, and an actual machine test were performed in the same manner as in Example 6. Table 2 shows the measurements of the universal hardness (HU) and the elastic deformation ratio, and the evaluation results of the actual machine test.

Example 21

An electrophotographic photosensitive member for measurement of surface properties and an electrophotographic photosensitive member for an actual machine test were prepared in the same manner as in Example 4 except that a coating liquid for a second charge transporting layer prepared as described below was used instead of that of Example 4 and that the coating liquid for a second charge transporting layer was coated on the first charge transporting layer not by spray coating but by dip coating. In addition, measurement of the universal hardness (HU) and the elastic deformation ratio, and an actual machine test were performed in the same manner as in Example 4. Table 2 shows the measurements of the universal hardness (HU) and the elastic deformation ratio, and the evaluation results of the actual machine test.

That is, first, 20 parts of polytetrafluoroethylene resin particles (trade name: Leblanc L-2, available from Daikin Industries, Ltd.) and 50 parts of ethanol were dispersed by means of a sand mill apparatus using a glass bead. Then, 60 parts of a hole-transporting compound having a structure represented by the following formula (E-9) and 50 parts of butyl alcohol were added to the dispersed product to dissolve the hole-transporting compound having the structure represented by the formula (E-9). After that, 20 parts of ethanol were additionally added to the solution to prepare the coating liquid for a second charge transporting layer of Example 21.

(E-9)

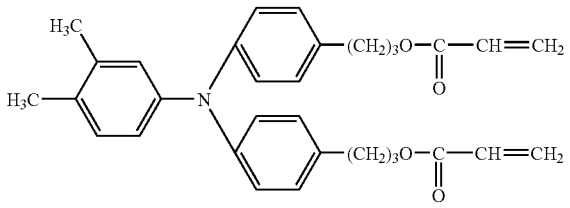

Example 22

An electrophotographic photosensitive member for measurement of surface properties and an electrophotographic photosensitive member for an actual machine test were prepared in the same manner as in Example 21 except that the irradiation dose in Example 21 in irradiating the coating liquid for a second charge transporting layer with an electron beam was changed from 4 Mrad to 1.5 Mrad. In addition, measurement of the universal hardness (HU) and the elastic deformation ratio, and an actual machine test were performed in the same manner as in Example 21. Table 2 shows the measurements of the universal hardness (HU) and the elastic deformation ratio, and the evaluation results of the actual machine test.

Comparative Example 1

An electrophotographic photosensitive member for measurement of surface properties and an electrophotographic photosensitive member for an actual machine test were prepared in the same manner as in Example 1 except that no heat treatment was performed after the irradiation of the coating liquid for a charge transporting layer with an electron beam. In addition, measurement of the universal hardness (HU) and the elastic deformation ratio, and an actual machine test were performed in the same manner as in Example 1. Table 3 shows the measurements of the universal hardness (HU) and the elastic deformation ratio, and the evaluation results of the actual machine test.

TABLE 3

| | | Elastic | Initial stage | After 40,000-sheet feeding endurance test | |
|---|---|---|---|---|---|
| | HU [N/mm$^2$] | deformation ratio[%] | Image evaluation | Image evaulation | Abrasion [μm] |
| Comparative Example 1 | 140 | 55 | Good | Good | 2.5 |
| Comparative Example 2 | 201 | 45 | Good | A flaw was generated on an image when 30,000 sheets were output. After that, flaws were generated at several positions. | 1.2 |
| Comparative Example 3 | 240 | 57 | Good | A flaw was generated on an image when | 0.4 |

TABLE 3-continued

| | HU [N/mm$^2$] | Elastic deformation ratio[%] | Initial stage Image evaluation | After 40,000-sheet feeding endurance test Image evaulation | Abrasion [μm] |
|---|---|---|---|---|---|
| | | | | 15,000 sheets were output. | |
| Comparative Example 4 | 216 | 40 | Good | A fog was generated on an image after 30,000 sheets were output. | 18.4 |
| Comparative Example 5 | 331 | 42 | Good | A flaw was generated on an image when 25,000 sheets were output. After that, flaws were generated at several positions. | 3.8 |
| Comparative Example 6 | 237 | 38 | Good | A flaw was generated on an image when 15,000 sheets were output. Numberless flaws were generated when 20,000 sheets were output so that the sheet feeding endurance test was discontinued. | — |
| Comparative Example 7 | 250 | 68 | Good | A flaw was generated on an image when 20,000 sheets were output. | 0.5 |
| Comparative Example 8 | 200 | 69 | Good However, a small number of flaws with a size of about 2 μm, which do not appear on an image, were generated. | A flaw was generated on an image when 40,000 sheets were output. | 0.3 |

Comparative Example 2

An electrophotographic photosensitive member for measurement of surface properties and an electrophotographic photosensitive member for an actual machine test were prepared in the same manner as in Example 2 except that no heat treatment was performed after the irradiation of the coating liquid for a charge transporting layer with an electron beam. In addition, measurement of the universal hardness (HU) and the elastic deformation ratio, and an actual machine test were performed in the same manner as in Example 2. Table 3 shows the measurements of the universal hardness (HU) and the elastic deformation ratio, and the evaluation results of the actual machine test.

Comparative Example 3

An electrophotographic photosensitive member for measurement of surface properties and an electrophotographic photosensitive member for an actual machine test were prepared in the same manner as in Example 9 except that no heat treatment was performed after the irradiation of the coating liquid for a charge transporting layer with an electron beam. In addition, measurement of the universal hardness (HU) and the elastic deformation ratio, and an actual machine test were performed in the same manner as in Example 9. Table 3 shows the measurements of the universal hardness (HU) and the elastic deformation ratio, and the evaluation results of the actual machine test.

Comparative Example 4

An intermediate layer and a charge generating layer were formed on a support in the same manner as in Example 1.

Next, 10 parts of the styryl compound having the structure represented by the above formula (E-2) and 10 parts of the polycarbonate resin (having a viscosity average molecular weight (Mv) of 20,000) having the repeating structural unit represented by the above formula (E-3) were dissolved in a mixed solvent of 50 parts of monochlorobenzene and 30 parts of dichloromethane to prepare a coating liquid for a charge transporting layer.

The coating liquid for a charge transporting layer was dip-coated on the charge generating layer and dried at 120° C. for 1 hour to form a charge transporting layer of 30 μm in thickness.

In this way, an electrophotographic photosensitive member for measurement of surface properties of Comparative Example 4 was prepared.

In addition, another electrophotographic photosensitive member was prepared in exactly the same manner as described above and used as an electrophotographic photosensitive member for an actual machine test of Comparative Example 4.

The universal hardness (HU) and elastic deformation ratio of the electrophotographic photosensitive member for measurement of surface properties of Comparative Example 4 were measured in the same manner as in Example 1. In addition, an actual machine test was performed on the electrophotographic photosensitive member for an actual machine test of Comparative Example 4 in the same manner as in Example 1. Table 3 shows the measurements of the universal hardness (HU) and the elastic deformation ratio, and the evaluation results of the actual machine test.

Comparative Example 5

An intermediate layer, a charge generating layer, and a charge transporting layer were formed on a support in the same manner as in Example 1.

Next, 100 parts of antimony-containing tin oxide fine particles having an average particle diameter of 0.02 μm (trade name: T-1, available from Mitsubishi Materials Corporation), 30 parts of (3,3,3-trifluoropropyl)trimethoxysilane (available from Shin-Etsu Chemical Co., Ltd.), and 300 parts of a solution composed of 95% ethanol and 5% water were mixed to prepare a solution. Then, the solution was dispersed for 1 hour by means of a milling apparatus. The solution that had undergone the dispersion was filtered, washed with ethanol, dried, and heated at 120° C. for 1 hour, thereby treating the surface of the antimony-containing tin oxide fine particles.

Next, 25 parts of a curing acrylic monomer (photo-polymerizable monomer) having a structure represented by the following formula (E-10), 5 parts of 2,2-dimethoxy-2-phenylacetone (photo-polymerization initiator), 50 parts of the antimony-containing tin oxide fine particles that had undergone the surface treatment, and 300 parts of ethanol were dispersed for 96 hours by means of a sand mill apparatus. After that, 20 parts of polytetrafluoroethylene resin particles (trade name: Leblanc L-2, available from Daikin Industries, Ltd.) were added to the dispersed product, and the whole was dispersed for an additional 8 hours by means of a sand mill apparatus to prepare a coating liquid for a protective layer.

(E-10)

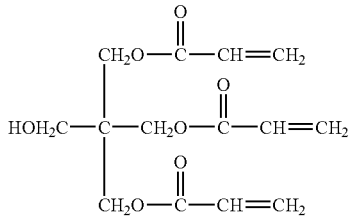

The coating liquid for a protective layer was dip-coated on the charge transporting layer, dried at 50° C. for 10 minutes, and irradiated with ultraviolet light having a light intensity of 1,000 mW/cm$^2$ emitted from a metal halide lamp for 30 seconds to form a protective layer of 3 μm in thickness.

In this way, an electrophotographic photosensitive member for measurement of surface properties of Comparative Example 5 was prepared.

In addition, another electrophotographic photosensitive member was prepared in exactly the same manner as described above and used as an electrophotographic photosensitive member for an actual machine test of Comparative Example 5.

The universal hardness (HU) and elastic deformation ratio of the electrophotographic photosensitive member for measurement of surface properties of Comparative Example 5 were measured in the same manner as in Example 1. In addition, an actual machine test was performed on the electrophotographic photosensitive member for an actual machine test of Comparative Example 5 in the same manner as in Example 1. Table 3 shows the measurements of the universal hardness (HU) and the elastic deformation ratio, and the evaluation results of the actual machine test.

Comparative Example 6

An intermediate layer, a charge generating layer, and a first charge transporting layer were formed on a support in the same manner as in Example 4.

Next, 10 parts of the polycarbonate resin (having a viscosity average molecular weight (Mv) of 20,000) having the repeating structural unit represented by the above formula (E-3) were dissolved in a mixed solvent of 100 parts of monochlorobenzene and 60 parts of dichloromethane. Then, 1 part of hydrophobic silica particles was mixed with and dispersed into the solution to prepare a coating liquid for a protective layer.

The coating liquid for a protective layer was spray-coated on the first charge transporting layer and dried at 110° C. for 60 minutes to form a protective layer of 1.0 μm in thickness.

In this way, an electrophotographic photosensitive member for measurement of surface properties of Comparative Example 6 was prepared.

In addition, another electrophotographic photosensitive member was prepared in exactly the same manner as described above and used as an electrophotographic photosensitive member for an actual machine test of Comparative Example 6.

The universal hardness (HU) and elastic deformation ratio of the electrophotographic photosensitive member for measurement of surface properties of Comparative Example 6 were measured in the same manner as in Example 1. In addition, an actual machine test was performed on the electrophotographic photosensitive member for an actual machine test of Comparative Example 6 in the same manner as in Example 1. Table 3 shows the measurements of the universal hardness (HU) and the elastic deformation ratio, and the evaluation results of the actual machine test.

Comparative Example 7

An intermediate layer, a charge generating layer, and a first charge transporting layer were formed on a support in the same manner as in Example 6.

Next, 30 parts of the hole-transporting compound having the structure represented by the above formula (E-1) and 10 parts of a hole-transporting compound having a structure represented by the following formula (E-11) were dissolved in a mixed solvent of 50 parts of monochlorobenzene and 50 parts of dichloromethane to prepare a coating liquid for a second charge transporting layer.

(E-11)

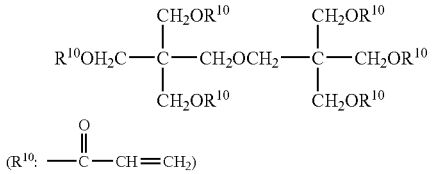

The coating liquid for a second charge transporting layer was spray-coated on the first charge transporting layer.

Next, the coating liquid for a second charge transporting layer coated on the first charge transporting layer was irradiated with an electron beam in an atmosphere with an oxygen concentration of 10 ppm at an accelerating voltage of 150 kV and an irradiation dose of 20 Mrad. After that, heat treatment was performed for 10 minutes in the same atmosphere under a condition for allowing the temperature of an electrophotographic photosensitive member (=the irradiated body for the electron beam) to reach 100° C. to thereby form a second charge transporting layer of 2 μm in thickness.

In this way, an electrophotographic photosensitive member for measurement of surface properties of Comparative Example 7 was prepared.

In addition, another electrophotographic photosensitive member was prepared in exactly the same manner as described above and used as an electrophotographic photosensitive member for an actual machine test of Comparative Example 7.

The universal hardness (HU) and elastic deformation ratio of the electrophotographic photosensitive member for measurement of surface properties of Comparative Example 7 were measured in the same manner as in Example 1. In addition, an actual machine test was performed on the electrophotographic photosensitive member for an actual machine test of Comparative Example 7 in the same manner as in Example 1. Table 3 shows the measurements of the universal hardness (HU) and the elastic deformation ratio, and the evaluation results of the actual machine test.

Comparative Example 8

An electrophotographic photosensitive member for measurement of surface properties and an electrophotographic photosensitive member for an actual machine test were prepared in the same manner as in Comparative Example 7 except the following three points. The first point is that the amount of the hole-transporting compound having the structure represented by the above formula (E-11) used in preparing a coating liquid for a second charge transporting layer was changed from 10 parts to 15 parts. The second point is that the irradiation dose in irradiating the coating liquid for a second charge transporting layer with an electron beam was changed from 20 Mrad to 1.5 Mrad. The third point is that the "condition for allowing the temperature of an electrophotographic photosensitive member to reach 100° C." in performing heat treatment after the irradiation with an electron beam was changed to a "condition for allowing the temperature of an electrophotographic photosensitive member to reach 80° C.". In addition, measurement of the universal hardness (HU) and the elastic deformation ratio, and an actual machine test were performed in the same manner as in Comparative Example 7. Table 3 shows the measurements of the universal hardness (HU) and the elastic deformation ratio, and the evaluation results of the actual machine test.

The above results show the following.

The electrophotographic photosensitive member of Comparative Example 1 the surface of which has an elastic deformation ratio in the range of 50 to 65% and a universal hardness (HU) of less than 150 N/mm$^2$ shows an extremely large surface abrasion amount after the sheet feeding endurance test as compared to the electrophotographic photosensitive members of Examples.

The electrophotographic photosensitive member of Comparative Example 2 the surface of which has a universal hardness (HU) in the range of 150 to 220 N/mm$^2$ and an elastic deformation ratio of less than 50% shows a large surface abrasion amount after the sheet feeding endurance test as compared to the electrophotographic photosensitive members of Examples. In addition, a flaw generates on the surface at the time of the sheet feeding endurance test, and a deep flaw also generates.

The electrophotographic photosensitive member of Comparative Example 3 the surface of which has an elastic deformation ratio in the range of 50 to 65% and a universal hardness (HU) in excess of 220 N/mm$^2$ involves the generation of a flaw at the time of the sheet feeding endurance test.

The electrophotographic photosensitive member of Comparative Example 4 the surface of which has a universal hardness (HU) in the range of 150 to 220 N/mm$^2$ and an elastic deformation ratio of less than 50% shows an extremely large surface abrasion amount after the sheet feeding endurance test as compared to the electrophotographic photosensitive members of Examples, and involves the generation of a fog on an output image during the sheet feeding endurance test.

The electrophotographic photosensitive member of Comparative Example 8 the surface of which has a universal hardness (HU) in the range of 150 to 220 N/mm$^2$ and an elastic deformation ratio in excess of 65% involves the generation of a flaw on the surface during (after) the sheet feeding endurance test.

Each of the electrophotographic photosensitive members of Comparative Examples 5 to 7 the surface of which has a universal hardness (HU) outside the range of 150 to 220 N/mm$^2$ and an elastic deformation ratio outside the range of 50 to 65% has a problem with regard to at least one of the generation of a flaw on the surface and the surface abrasion.

Each of the electrophotographic photosensitive members of Examples 1 to 20 the surface of which has a universal hardness (HU) in the range of 150 to 220 N/mm$^2$ and an elastic deformation ratio in the range of 50 to 65% provides alleviated generation of a flaw on the surface and alleviated surface abrasion as compared to the electrophotographic photosensitive members of Comparative Examples 1 to 8. Furthermore, each of the electrophotographic photosensitive members of Examples 1 to 6, 14, 16, 17, and 19 to 22 the surface of which has a universal hardness (HU) in the range of 160 to 200 N/mm$^2$ provides an improved output image after the sheet feeding endurance test as compared to the electrophotographic photosensitive members of Examples 7 to 13, 15, and 18.

As described above, according to the present invention, there are provided an electrophotographic photosensitive member which maintains high sensitivity even if it is used repeatedly, and on the surface of which a flaw or wear hardly generates, and a process cartridge and an electrophotographic apparatus each having the electrophotographic photosensitive member.

This application claims priority from Japanese Patent Application No. 2003-280190 filed Jul. 25, 2003, which is hereby incorporated by reference herein.

What is claimed is:

1. An electrophotographic photosensitive member comprising a support and a photosensitive layer on the support, wherein a surface of the electrophotographic photosensitive member has a universal hardness (HU) in a range of between 160 and 200 N/mm$^2$ and an elastic deformation ratio in a range of between 50 and 65%, wherein the universal hardness (HU) of the surface of the electrophotographic photosensitive member and the elastic deformation are measured at a temperature of 25° C. and a relative humidity of 50% by bringing a Vickers square cone diamond indenter with an angle between opposite faces of 136° into abutment with the surface of the electrophotographic photosensitive member, continuously applying a load to the indenter with a final value of the load applied being 6 mN, employing a time period during which the indenter is maintained under the final value of the load of 6 mN of 0.1 second and directly reading an indentation depth under the load.

2. The electrophotographic photosensitive member according to claim 1, wherein a surface layer of the electrophotographic photosensitive member is a layer formed by polymerizing a hole-transporting compound having a chain polymerizable functional group.

3. The electrophotographic photosensitive member according to claim 2, wherein the hole-transporting compound having a chain polymerizable functional group comprises a hole-transporting compound having 2 or more chain polymerizable functional groups.

4. The electrophotographic photosensitive member according to claim 2, wherein the hole-transporting compound having a chain polymerizable functional group has at least one group of an acryloyloxy group and a methacryloyloxy group as the chain polymerizable functional group.

5. The electrophotographic photosensitive member according to claim 2, wherein the surface layer of the electrophotographic photosensitive member comprises a layer formed by polymerizing the hole-transporting compound having a chain polymerizable functional group by using radiation.

6. The electrophotographic photosensitive member according to claim 5, wherein the radiation is an electron beam.

7. A process cartridge comprising an electrophotographic photosensitive member and at least one means selected from the group consisting of charging means, developing means, transferring means, and cleaning means which are integrally supported, and being detachably mountable to a main body of an electrophotographic apparatus, wherein the electrophotographic photosensitive member has a support and a photosensitive layer on the support; and a surface of the electrophotographic photosensitive member has a universal hardness (HU) in a range of between 160 and 200 N/mm$^2$ and an elastic deformation ratio in a range of between 50 and 65%, wherein the universal hardness (HU) of the surface of the electrophotographic photosensitive member and the elastic deformation are measured at a temperature of 25° C. and a relative humidity of 50% by bringing a Vickers square cone diamond indenter with an angle between opposite faces of 136° into abutment with the surface of the electrophotographic photosensitive member, continuously applying a load to the indenter with a final value of the load applied being 6 mN. employing a time period during which the indenter is maintained under the final value of the load of 6 mN of 0.1 second and directly reading an indentation depth under the load.

8. An electrophotographic apparatus comprising an electrophotographic photosensitive member, charging means, exposure means, developing means and transferring means, wherein the electrophotographic photosensitive member has a support and a photosensitive layer on the support; and a surface of the electrophotographic photosensitive member has a universal hardness (HU) in a range of between 160 and 200 N/mm$^2$ and an elastic deformation ratio in a range of between 50 and 65%, wherein the universal hardness (HU) of the surface of the electrophotographic photosensitive member and the elastic deformation are measured at a temperature of 25° C. and a relative humidity of 50% by bringing a Vickers square cone diamond indenter with an angle between opposite faces of 136° into abutment with the surface of the electrophotographic photosensitive member, continuously applying a load to the indenter with a final value of the load applied being 6 mN, employing a time period during which the indenter is maintained under the final value of the load of 6 mN of 0.1 second and directly reading an indentation depth under the load.

* * * * *

UNITED STATES PATENT AND TRADEMARK OFFICE

CERTIFICATE OF CORRECTION

PATENT NO. : 7,378,205 B2
APPLICATION NO. : 10/896856
DATED : May 27, 2008
INVENTOR(S) : Michiyo Sekiya et al.

It is certified that error appears in the above-identified patent and that said Letters Patent is hereby corrected as shown below:

COLUMN 31:

CE 55, "

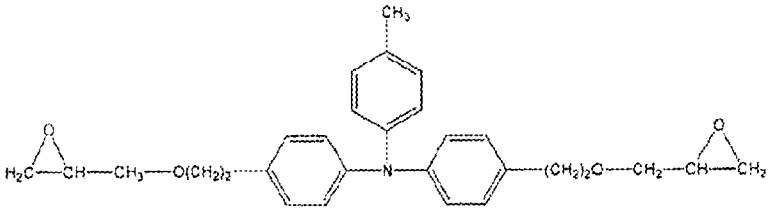

"

should read

--

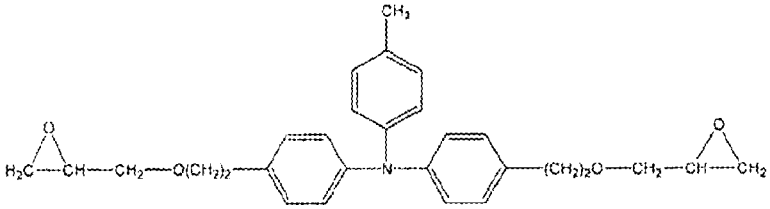

--.

COLUMN 35:

CE 67, "

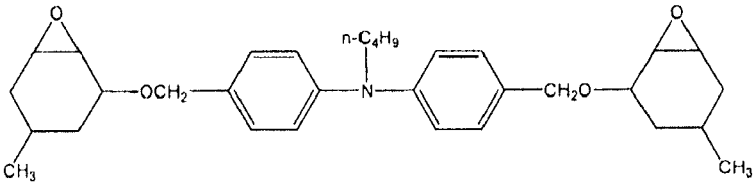

"

should read

--

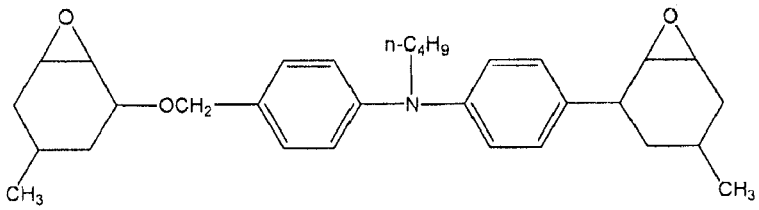

--.

UNITED STATES PATENT AND TRADEMARK OFFICE

CERTIFICATE OF CORRECTION

PATENT NO. : 7,378,205 B2
APPLICATION NO. : 10/896856
DATED : May 27, 2008
INVENTOR(S) : Michiyo Sekiya et al.

It is certified that error appears in the above-identified patent and that said Letters Patent is hereby corrected as shown below:

COLUMN 37:

CE 76, “ 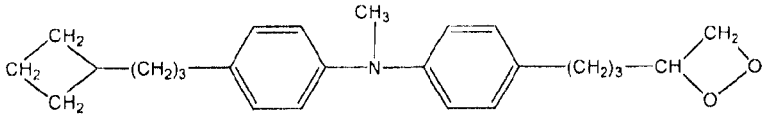 ”

should read

-- 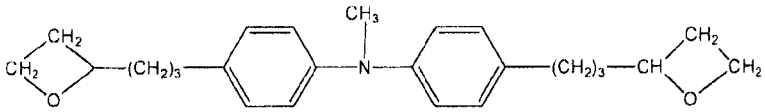 --;

CE 77, “ 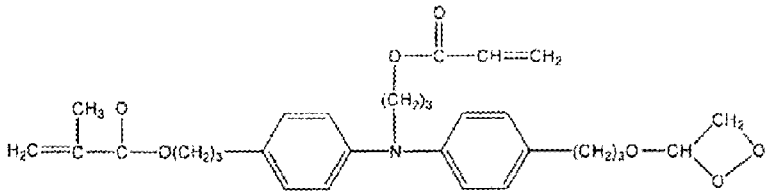 ”

should read

-- 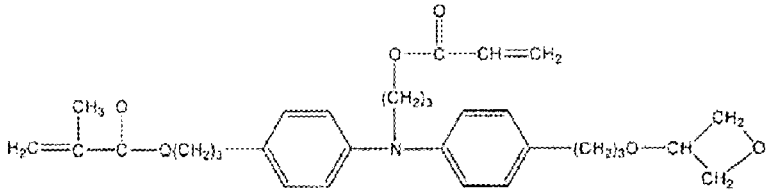 --;

and

CE 78, “ 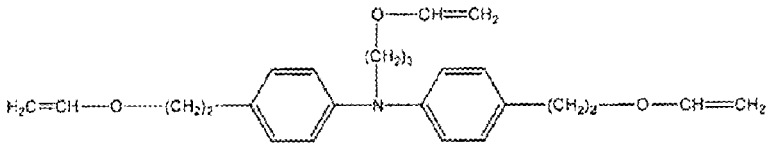 ”

should read

-- 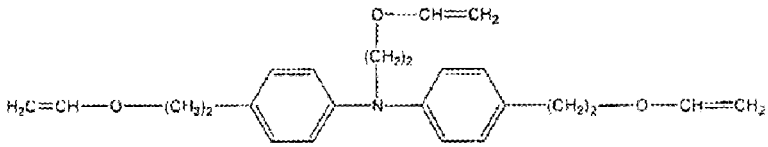 --.

UNITED STATES PATENT AND TRADEMARK OFFICE

CERTIFICATE OF CORRECTION

PATENT NO. : 7,378,205 B2
APPLICATION NO. : 10/896856
DATED : May 27, 2008
INVENTOR(S) : Michiyo Sekiya et al.

It is certified that error appears in the above-identified patent and that said Letters Patent is hereby corrected as shown below:

COLUMN 41:

CE 86, “ 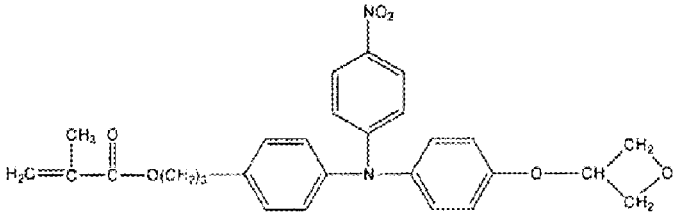 ”

should read

-- 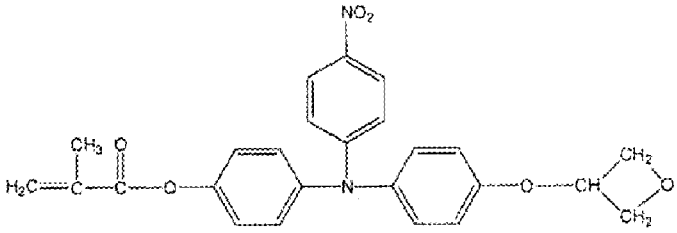 --; and

CE 88, “ 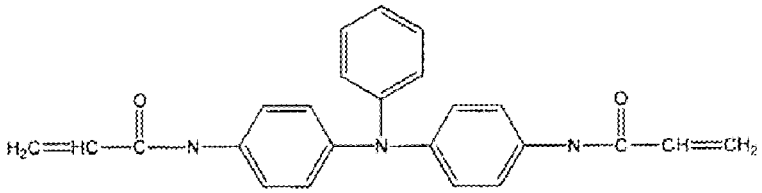 ”

should read

-- 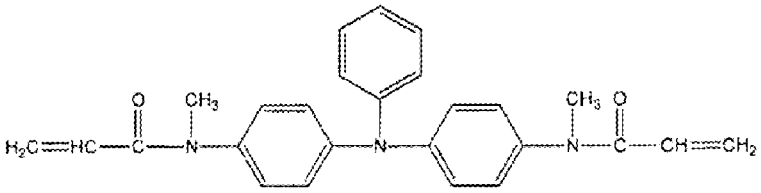 --.

UNITED STATES PATENT AND TRADEMARK OFFICE

CERTIFICATE OF CORRECTION

PATENT NO. : 7,378,205 B2
APPLICATION NO. : 10/896856
DATED : May 27, 2008
INVENTOR(S) : Michiyo Sekiya et al.

It is certified that error appears in the above-identified patent and that said Letters Patent is hereby corrected as shown below:

COLUMN 45:

CE 102,

"

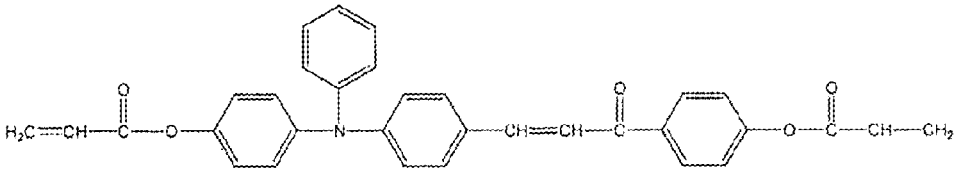

"

should read

--

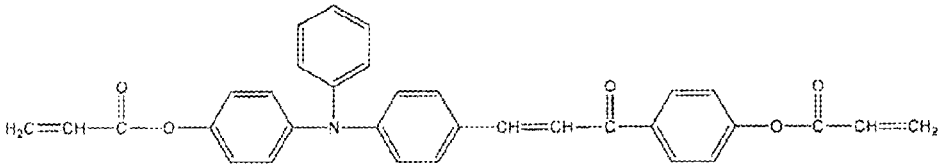

--;

and

UNITED STATES PATENT AND TRADEMARK OFFICE

CERTIFICATE OF CORRECTION

PATENT NO. : 7,378,205 B2
APPLICATION NO. : 10/896856
DATED : May 27, 2008
INVENTOR(S) : Michiyo Sekiya et al.

It is certified that error appears in the above-identified patent and that said Letters Patent is hereby corrected as shown below:

(COLUMN 45 Continued:)

CE 103,

"

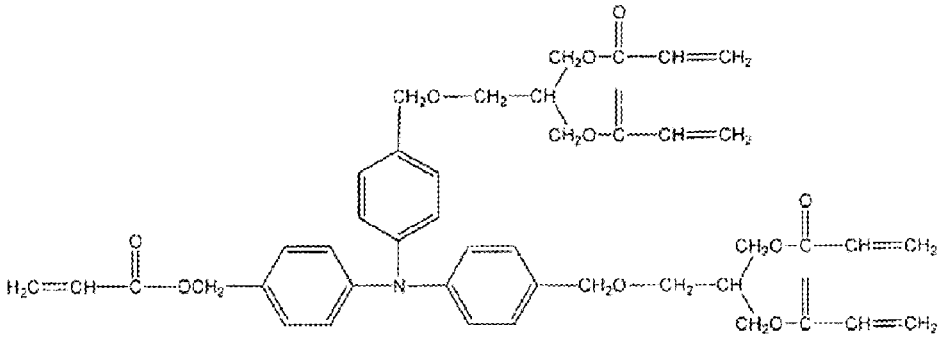

"

should read

--

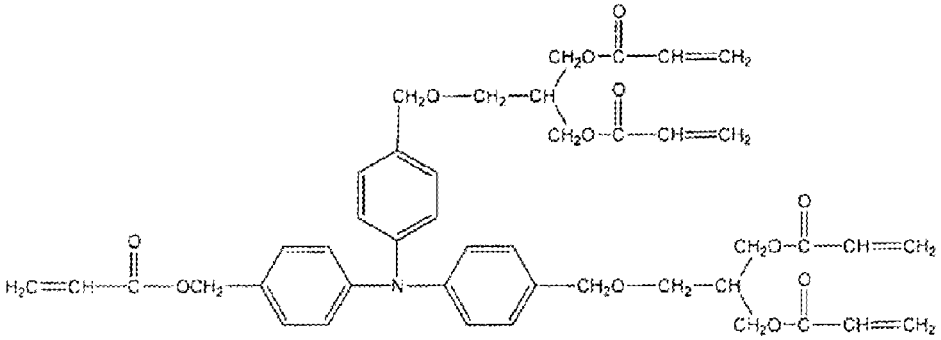

--.

UNITED STATES PATENT AND TRADEMARK OFFICE

CERTIFICATE OF CORRECTION

PATENT NO. : 7,378,205 B2
APPLICATION NO. : 10/896856
DATED : May 27, 2008
INVENTOR(S) : Michiyo Sekiya et al.

It is certified that error appears in the above-identified patent and that said Letters Patent is hereby corrected as shown below:

COLUMN 47:

CE 105, "

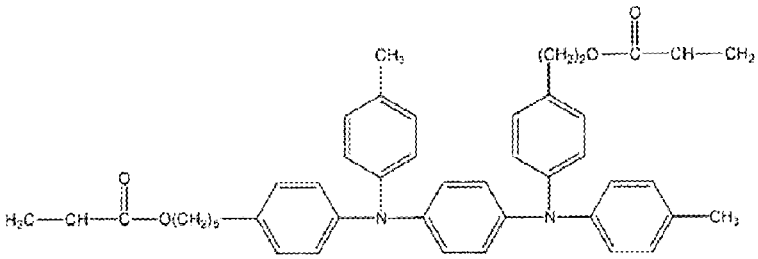

"

should read

--

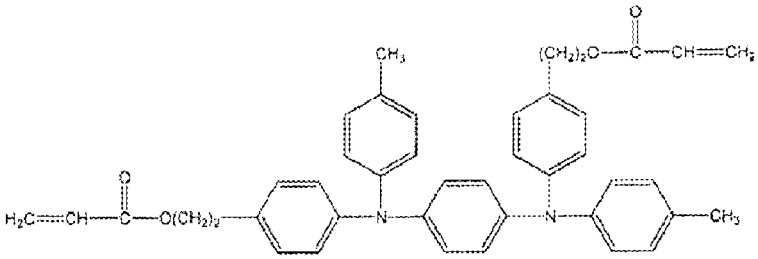

--;

UNITED STATES PATENT AND TRADEMARK OFFICE

CERTIFICATE OF CORRECTION

PATENT NO. : 7,378,205 B2
APPLICATION NO. : 10/896856
DATED : May 27, 2008
INVENTOR(S) : Michiyo Sekiya et al.

It is certified that error appears in the above-identified patent and that said Letters Patent is hereby corrected as shown below:

(COLUMN 47 Continued:)

CE 108,

"

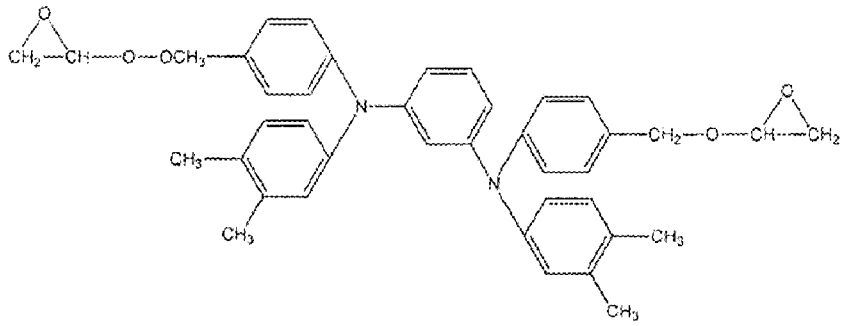

"

should read

--

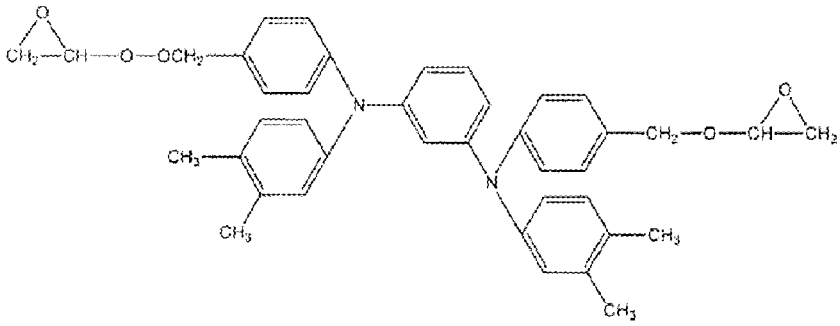

--.

UNITED STATES PATENT AND TRADEMARK OFFICE

CERTIFICATE OF CORRECTION

PATENT NO. : 7,378,205 B2
APPLICATION NO. : 10/896856
DATED : May 27, 2008
INVENTOR(S) : Michiyo Sekiya et al.

It is certified that error appears in the above-identified patent and that said Letters Patent is hereby corrected as shown below:

COLUMN 49:

CE 114,

“ 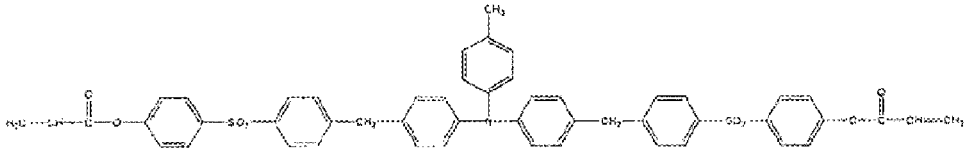 ”

should read

-- 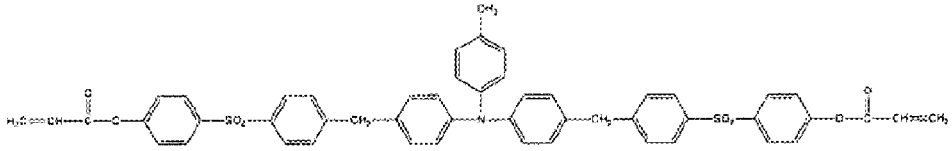 --;

and

CE 115,

“ 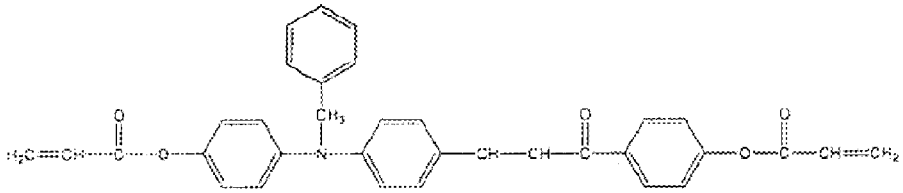 ”

should read

-- 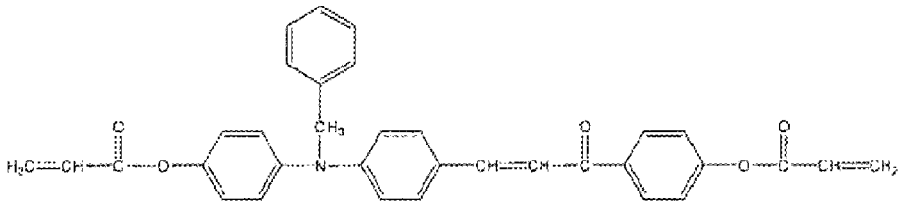 --.

UNITED STATES PATENT AND TRADEMARK OFFICE

CERTIFICATE OF CORRECTION

PATENT NO. : 7,378,205 B2
APPLICATION NO. : 10/896856
DATED : May 27, 2008
INVENTOR(S) : Michiyo Sekiya et al.

It is certified that error appears in the above-identified patent and that said Letters Patent is hereby corrected as shown below:

COLUMN 58:

Line 17, "by." should read --by--.

Signed and Sealed this

Ninth Day of December, 2008

JON W. DUDAS
*Director of the United States Patent and Trademark Office*